US010202717B2

(12) United States Patent
Alexander et al.

(10) Patent No.: US 10,202,717 B2
(45) Date of Patent: Feb. 12, 2019

(54) FABRIC ENHANCER AND LAUNDRY ADDITIVE DISPENSATION IN LAUNDRY APPLIANCES

(71) Applicant: WHIRLPOOL CORPORATION, Benton Harbor, MI (US)

(72) Inventors: Benjamin E. Alexander, Stevensville, MI (US); Gregory R. Fulmer, Saint Joseph, MI (US); Kaustav Ghosh, Woodbury, MN (US); Kurt L. Masciovecchi, Stevensville, MI (US); Robert J. Pinkowski, Baroda, MI (US); Brian K. Rogers, Watervliet, MI (US); Raymond Thompson, South Bend, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 178 days.

(21) Appl. No.: 15/257,069

(22) Filed: Sep. 6, 2016

(65) Prior Publication Data

US 2017/0159223 A1 Jun. 8, 2017

Related U.S. Application Data

(60) Provisional application No. 62/262,023, filed on Dec. 2, 2015.

(51) Int. Cl.

| | |
|---|---|
| ***D06F 35/00*** | (2006.01) |
| ***D06F 39/02*** | (2006.01) |
| ***D06F 39/08*** | (2006.01) |
| ***D06F 25/00*** | (2006.01) |

(52) U.S. Cl.

CPC ..... *D06F 35/006* (2013.01); *D06F 25/00* (2013.01); *D06F 39/02* (2013.01); *D06F 39/085* (2013.01)

(58) Field of Classification Search

CPC ..... D06F 35/006

See application file for complete search history.

(56) References Cited

U.S. PATENT DOCUMENTS

2012/0246837 A1* 10/2012 Ihne ..... D06F 35/006 8/137

2013/0086754 A1* 4/2013 Hendrickson ..... D06F 39/003 8/137

* cited by examiner

*Primary Examiner* — Jason Y Ko

(57) ABSTRACT

Systems, components, and methodologies for uniformly distributing fabric enhancers onto laundry loads in laundry treating appliances. The methods may include accepting one or more of a laundry detergent, a fabric softener, and a bleach for dispensation into the laundry treating appliance, accepting a plurality of fabric enhancers in respective compartments of a fabric enhancer storage assembly, receiving indications of the types of fabric enhancers stored in the respective compartments, selecting dispensation patterns suitable for each of the types of fabric enhancers, and dispensing the plurality of fabric enhancers in accordance with the selected dispensation patterns.

12 Claims, 17 Drawing Sheets

FABRIC ENHANCER AND LAUNDRY ADDITIVE DISPENSATION IN LAUNDRY APPLIANCES

CROSS REFERENCE TO RELATED APPLICATIONS

The present application claims the benefit of U.S. Provisional Application No. 62/262,023, filed Dec. 2, 2015, which is incorporated by reference in its entirety.

FIELD

The present disclosure relates to laundry, and more specifically to systems, components, and methodologies for washing, treating, and drying fabrics in washing machines and dryers.

BACKGROUND

The present disclosure relates to systems, components, and methodologies for treating fabrics with treating chemistries. Conventional laundry appliances treat fabrics with various types of treating chemistries, including detergents, bleaches, and fabric softeners. These conventional laundry appliances apply the treating chemistries onto portions of the fabric, either in concentrated form or diluted with other liquids as part of a wash liquor.

By way of example, some conventional laundry appliances may dispense the treating chemistries into the laundry appliance's drum or basket where the chemistries contact fabric, some may dispense the treating chemistry between the laundry appliance's tub and drum or basket such that the treating chemistry flows through perforations in the drum or basket to contact fabric, and some may activate the laundry appliance's pump system to recirculate wash liquor containing treating chemistries onto fabrics disposed within the drum or basket. These conventional laundry appliances may include dispenser drawers or dispenser trays having compartments for storing the treating chemistries. These drawers and trays may include siphons or similar structures that draw treating chemistries from the compartments and allow the treating chemistries to drop or flow to the desired location (e.g., within the tub, drum, or basket), such that they ultimately contact the fabric.

A disadvantage of conventional laundry appliances is that the treating chemistries are not uniformly distributed across the surface of the fabrics or within the internal structures of the fabrics. This can be due in part to the nature of the treating chemistries themselves, whose fluidic structures may contain large amalgamations or vesicles that, when applied to fabrics, result in splotchy and uneven distribution. In addition, certain fabric enhancers may be positively charged while cotton and similar fabrics may be negatively charged, making uniform distribution of the chemistry difficult. These problems are exacerbated by limitations of conventional wash cycles and dispensation methodologies. The manner by which a wash cycle is programmed, including the selection, timing, and sequence of operations used for a wash cycle, can have a significant impact on the uniformity of distribution of treating chemistries. Additionally, the manner by which treating chemistries are dispensed during the course of a wash cycle can have a significant impact on uniformity. Yet conventional laundry appliances do not configure wash cycles in a manner that promotes sufficient uniformity of distribution, and do not perform dispensing operations during wash cycles in a manner that optimizes uniformity.

Lack of uniformity inhibits the performance of many fabric enhancers—for example, poorly distributed detergents or bleaches will not clean or whiten fabrics as well they would if they were uniformly distributed. Concentrated distribution of chemistry can damage garments if not diluted properly or induce adverse chemical reactions when heated in the dryer. Moreover, lack of distribution uniformity limits the types of treating chemistries that laundry appliances can use. Certain fabric enhancers could theoretically provide tremendous consumer benefit, but require substantial uniformity of distribution if they are to be effective. Unless laundry appliances can provide the required uniformity, these fabric enhancers cannot effectively be used. These drawbacks may be heightened in the future because less water and energy may be available to evenly distribute fabric enhancers due to increasingly stringent water and energy restrictions.

Accordingly, a need exists for systems, components, and methodologies that more uniformly dispense treating chemistries onto fabrics within laundry appliances.

SUMMARY

The present disclosure sets forth systems, components, and methodologies that improve the uniformity with which fabric enhancing treating chemistries can be distributed onto laundry loads. As explained above, conventional laundry appliances are limited by the lack of uniformity with which fabric enhancers are distributed onto laundry loads. The present disclosure sets forth fabric enhancer dispensing systems that improve the uniformity with which fabric enhancers are distributed, wash cycles and distribution methodologies that improve uniformity of distribution, and examples of fabric enhancers and associated use cases that can leverage this improved uniformity.

Different types of fabric enhancers require different amounts of uniformity in order to be effective in providing consumers with benefits. For example, a fragrance enhancer may be effective even if it only covers 5-10% of a target fabric, akin to how a person may be satisfied after spritzing perfume in just a few locations on his or her body. Fabric softeners typically require more uniformity, including up to 45% or more, to be effective. Large classes of potential fabric enhancers, however, require substantially more uniformity, such as 80%, 90%, or close to 100% coverage. One example is a UV protectant—a UV protectant may not be satisfactory for a consumer if it blocks against dangerous UV rays in some, but not all, locations.

The systems, components, and methodologies of the present disclosure enable such uniformities. Thus, the present disclosure provides the mechanisms and methodologies by which laundry treating appliances can effectively dispense new types of fabric enhancers to achieve previously unrealized consumer benefits. As will be described below, examples of fabric enhancers enabled by the present disclosure include stain guards, anti-microbials, UV protectors, wrinkle releasers, and stiffeners, among others. Moreover, even for fabric enhancers whose performance could otherwise be consider satisfactory with inferior distribution (such as fragrance enhancers, as explained above), the enhanced uniformity enabled by the present disclosure greatly improves the performance and effect of such fabric enhancers.

According to one aspect, the present disclosure sets forth fabric enhancer dispensing systems that improve the uniformity with which fabric enhancers are distributed. In certain implementations, the fabric enhancer dispensing systems employ a pressure-driven, metered, mixing and dispensing pump. The pump accepts and mixes fabric enhancers and water and provides sufficient shear force and mixing to break apart amalgamations or vesicles within the fabric enhancers. The present disclosure sets forth other dispensation mechanisms that interoperate with the pressure-drive pump, including nozzle configurations and spray patterns, that further improve uniformity of distribution. In addition, the present disclosure sets forth various configurations of pumps, selectively actuable relays, and nozzles that allow for selective dispensation of one or more different types of fabric enhancers that can provide different types of consumer benefits.

According to another aspect, the present disclosure sets forth wash cycle operations that improve uniformity of distribution. Experimentation and analysis conducted by the applicants has revealed that certain wash cycle operations can substantially improve fabric enhancer uniformity, as described in more detail below.

According to another aspect, the present disclosure sets forth examples of fabric enhancers and associated use cases that can leverage the improved uniformity offered by the disclosed dispensing systems. Examples include whitening or bluing enhancers, color fidelity enhancers, malodor prevention enhancers, stain repellant enhancers, soil release enhancers, shape management enhancers, fragrance enhancers, anti-microbial enhancers, and UV protectant enhancers.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

The figures and descriptions provided herein may have been simplified to illustrate aspects that are relevant for a clear understanding of the described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

By way of overview, exemplary dispensing systems and components that improve the uniformity with which fabric enhancers are distributed are discussed below in connection with FIGS. 1A-4C. Exemplary wash cycle operations that improve uniformity of distribution are discussed below in connection with FIGS. 5-8. Exemplary fabric enhancer dispensation use cases are discussed in connection with FIGS. 9-10. Exemplary fabric enhancers that are enabled by the systems, components, and methodologies of the present disclosure are discussed subsequent to the description of the figures.

Figure 1A:
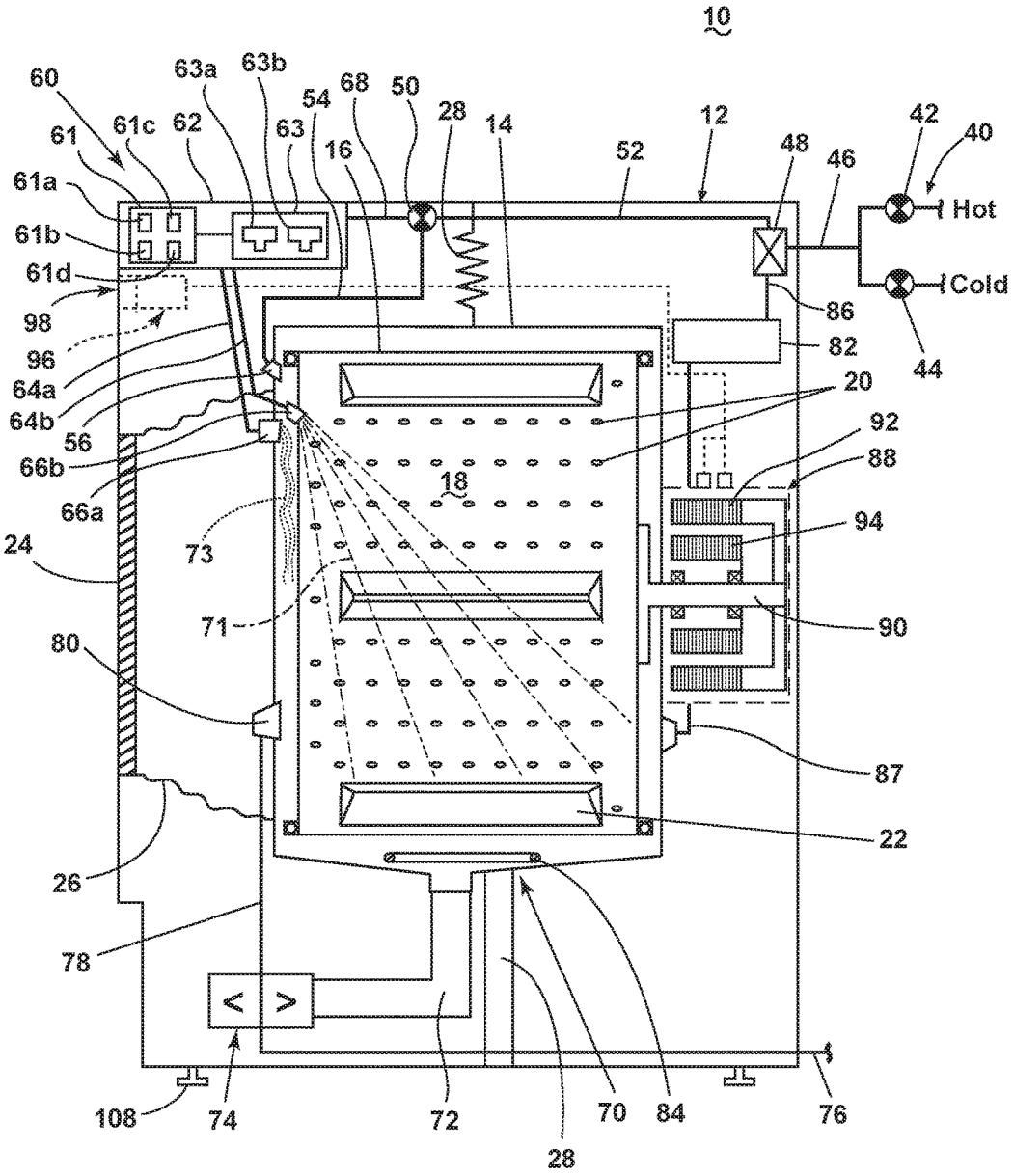
FIG. 1A is a side perspective view of a laundry treating appliance in the form of a horizontal axis washing machine illustrating a fabric enhancer dispensing system in accordance with the present disclosure.

FIGS. 1A-4C depict exemplary dispensing systems and components that improve the uniformity with which fabric enhancers are distributed. FIG. 1A shows an exemplary laundry treating appliance in the form of a horizontal axis washing machine 10 and illustrates a fabric enhancer dispensing system 60 in accordance with the present disclosure. Before discussing the structure and operation of the fabric enhancer dispensing system 60, an overview of other structural aspects of the washing machine 10 is provided.

The washing machine 10 may include a structural support system comprising a cabinet 12 that defines a housing within which a laundry holding system resides. The cabinet 12 may be a housing having a chassis and/or a frame defining an interior that encloses components typically found in a conventional washing machine, such as motors, pumps, fluid lines, controls, sensors, transducers, and the like.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of this disclosure for the laundry holding system to comprise only a tub with the tub defining the laundry treating chamber. A suspension system 28 dynamically suspends the laundry holding system within the structural support system.

The laundry holding system may further include a door 24 that may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may also include at least one ball balancing ring 38 containing a balancing material moveable within the ball balancing ring 38 to counterbalance an imbalance that may be caused by laundry in the treating chamber 18 during rotation of the drum 16. The balancing material may be in the form of metal balls, fluid or a combination thereof. For example, the ball balancing ring 38 may comprises a plurality of metal balls suspended in a substantially viscous fluid. The ball balancing ring 38 may extend circumferentially around a periphery of the drum 16 and may be located at any desired location along an axis of rotation of the drum 16. When multiple ball balancing rings 38 are present, they may be equally spaced along the axis of rotation of the drum 16.

The washing machine 10 also includes a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options. The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to this disclosure. It is contemplated that the controller is a microprocessor-based controller that implements control software and sends/receives one or more electrical signals to/from each of the various working components to affect the control software. As an example, proportional control (P), proportional integral control (PI), and proportional derivative control (PD), or a combination thereof, a proportional integral derivative control (PID control), may be used to control the various components. Additional detail regarding the operation of the controller 96 will be provided in connection with FIG. 3, below.

Of relevance to the present disclosure, the washing machine 10 includes a fabric enhancer dispensing system 60 for dispensing fabric enhancers to the treating chamber 18. The fabric enhancer dispensing system 60 includes a dispenser 62 that has a fabric enhancer storage assembly 61 and a pump assembly 63. The fabric enhancer storage assembly 61 includes compartments 61*a-d* for storing respective types of fabric enhancers. The pump assembly 63 includes one or more pumps 63*a-b* for pumping fabric enhancers into the treating chamber 18. The fabric enhancer storage assembly 61 is fluidically coupled with the pump assembly 63 such that fabric enhancers stored in compartments 61*a-d* can be pumped into the treating chamber 18 through the pumps 63*a-b*. The pump assembly 63 is also fluidically coupled to a household water supply 40 such that fabric enhancers can be mixed or diluted with water prior to dispensation.

Although the fabric enhancer storage assembly 61 and the pump assembly 63 are depicted as being part of a common module, other configurations are within the scope of the present disclosure. The fabric enhancer storage assembly 61 and the pump assembly 63 can be located in different locations of the washing machine 10, so long as they are fluidically coupled. In fact, the fabric enhancer storage assembly 61 and/or the pump assembly 63 can be provided as modules separate from and external to the washing machine 10, and external fluidic conduits may provide the required fluidic connections. For example, the fabric enhancer storage assembly 61 may be implemented as an external bulk dispenser, as will be further explained below.

The depicted fabric enhancer storage assembly 61 includes four compartments 61*a-d*, but any number of compartments is within the scope of the present disclosure. Indeed, because the systems, components, and methodologies of the present disclosure enable a wide variety of fabric enhancers not used by conventional laundry treating appliances, there may be implementations in which dozens of compartments are used, each containing a different type of fabric enhancer. Likewise, the pump assembly 63 is depicted as having two pumps, but implementations with just one pump or several additional pumps are within the scope of the present disclosure. The specific manner in which different numbers of compartments 61*a-d* can fluidically couple with different numbers of pumps 63*a-b* will be described in more detail below.

In use, a user can load desired fabric enhancers into compartments 61*a-d* of the fabric enhancer storage assembly 61. Washing machine 10 may be pre-configured to receive specific types of fabric enhancers in predetermined compartments 61*a-d*. In such a case, each of the compartments 61*a-d* may be labeled with a particular type of fabric enhancer (e.g., compartment 61*a* may be labeled "Wrinkle Guard," compartment 61*b* may be labeled "UV protection," etc.).

Alternatively, compartments 61*a-d* can be user-configurable. A user may assign, using the user interface 98, certain compartments 61*a-d* to be associated with respective fabric enhancer types. For example, the user may decide that compartment 61*a* will be for a wrinkle guard fabric enhancer, compartment 61*b* will be for a UV protection fabric enhancer, etc. The user selections may be stored in a memory 100 of the controller 96 (to be discussed in connection with FIG. 3) such that the CPU 102 of the controller 96 can access information required to selectively actuate appropriate valves and pumps to dispense appropriate fabric enhancers at appropriate times. User-configurable compartments 61*a-d* can enable consumers to take advantage of a wide array of fabric enhancers, even where the number of compartments 61*a-d* is relatively few. For example, a user can purchase a dozen or more types of fabric enhancers and, for any given wash, select a subset of fabric enhancers for that wash by making appropriate selections using user interface 98.

The pump assembly 63 accepts fabric enhancers from the fabric enhancer storage assembly 61, accepts water from the water supply 40, mixes the fabric enhancers and water, and pumps the fabric enhancers to the treating chamber 18 via one or more dispensing conduits. For illustrative purposes only, two conduits 64*a*, 64*b* are depicted. Implementations with just one conduit, or several additional conduits are within the scope of the present disclosure.

In some uses, fabric enhancers from the fabric enhancer storage assembly 61 flow directly to the pump assembly 63, where the fabric enhancers are mixed with water. In other scenarios, water from the water supply 40 may also flow into the fabric enhancer storage assembly 61, such that the fabric enhancer is pre-mixed with water prior to flowing to the pump assembly 63. As yet another alternative, there may be separate mixing chambers in which different types of fabric enhancers and/or water can be pre-mixed to form a wash liquor that is ultimately provided to the pump assembly 63. Examples of mixing chambers are disclosed in U.S. Pat. No. 8,047,024, filed May 7, 2007, and entitled "Control and wash cycle for activation and deactivation of chemistry in the wash bath of an automatic washer," which is incorporated by reference herein in its entirety.

As mentioned, the pump assembly 63 can include one or more pumps 63*a-b*. The pumps 63*a-b* can be of any suitable type. However, as illustrated, the pumps 63*a-b* are water pressure pumps as described in U.S. patent application Ser. No. 14/302,529 ("the '529 application"), filed Jun. 12, 2014, and entitled "PRESSURE-DRIVEN METERED MIXING DISPENSING PUMPS AND METHODS", whose disclosure is incorporated by reference in its entirety. The water pressure pump of the '529 application is beneficial in that it does not require electricity and delivers small quantities of treating chemistry, which are pre-mixed with water prior to delivery to the conduits 64*a*, 64*b*. The small quantities of treating chemistry delivered by the water pressure pump enables fine control over the dispensing of the total amount of treating chemistry. The pre-mixing by the water pressure pump is also great enough that the shear forces acting on the treating chemistry break apart amalgamations or vesicles in the treating chemistry, which enables enhanced uniformity of fabric enhancer distribution.

It should be understood that other types of pumps are within the scope of the present disclosure, including electric pumps.

The water supply 40 may supply water directly to the dispensing system 60 at a desired temperature based on appropriate configuration of valves 42, 44, and diverter mechanisms 48, 50. Alternatively, the water supply 40 may also supply water directly to the tub 14 at a desired temperature based on appropriate configuration of valves 42, 44, and diverter mechanisms 48, 50. Specifically, the water supply 40 includes separate valves 42 and 44 for controlling the flow of hot and cold water, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48, which may direct the flow of liquid to a supply conduit 52. The second diverter mechanism 50 on the supply conduit 52 may direct the flow of liquid to a tub outlet conduit 54, which may be provided with a spray nozzle 56 or other dispensing mechanism to spray the flow of liquid into the tub 14. In this manner, water from the household water supply 40 may be supplied directly to the tub 14.

Water may instead be supplied to the dispensing system 60 by changing the configuration of the diverter mechanism 50 such that water flows into the dispensing system 60. This enables the dispensing system 60 to mix metered doses of treating chemistry with water. The pumps 63*a*, 63*b* meter a predetermined amount of fabric enhancer and mix the fabric enhancer with water in response to the selective supplying of water to the pumps 63*a*, 63*b*. The pumps 63*a*, 63*b* are operated by selectively controlling water valves associated with the pumps 63*a*, 63*b*, as explained in further detail in the '529 application.

The resultant mixture is pumped out of the dispensing conduits 64*a*, 64*b*. The dispensing conduits 64*a*, 64*b* terminate in dispensing nozzles 66*a*, 66*b* that are configured to dispense the fabric enhancers according to suitable dispensing patterns. In this example, dispensing conduit 64*a* terminates with dispensing nozzle 66*a* to dispense fabric enhancer into a space between the tub 14 and the drum 16. The fabric enhancer may be dispensed in any desired pattern and with any desired amount of pressure. In this example, the dispensing nozzle 66*a* may be configured to dispense a flow or stream of treating chemistry into the tub 14 by gravity, i.e., a non-pressurized stream 73. The fabric enhancer may then enter the treating chamber 18 through perforations 20 in the drum 16, or through a recirculation system that will be described in greater detail below.

Dispensing conduit 64*b*, on the other hand, terminates with dispensing nozzle 66*b* to dispense fabric enhancer directly into the drum 16. In this example, nozzle 66*b* is a spray nozzle that dispenses fabric enhancer in accordance with a fan-like or cone-like distribution pattern 71.

As illustrated, dispenser 62 is a single use fabric enhancer dispenser, in which a user may fill compartments 61*a-d* with fabric enhancer on a per-wash basis. Alternatively, dispenser 62 can be a bulk dispenser, such that a user may fill compartments 61*a-d* with larger amounts of fabric enhancer. In such a case, washing machine 10 can be configured to meter out appropriate quantities of fabric enhancer during each wash cycle, and to notify the user when additional fabric enhancer must be loaded into compartments 61*a-d*.

In one exemplary implementation, fabric enhancers are provided in bulk containers that are off-the-shelf-type consumable bottles available in retail environments. Systems, components, and methodologies for such bulk dispensation are further detailed in Provisional Appl. No. 62/200,706, entitled "LAUNDRY TREATING APPLIANCE AND BULK DISPENSER," filed on Aug. 4, 2015, which is incorporated by reference herein in its entirety. Any of the systems, components, and methodologies of the present disclosure may be applied in conjunction with any of the systems, components, and methodologies of Provisional Appl. No. 62/200,706.

In addition to the single-use and bulk dispensers referenced above, additional examples of suitable dispensers are disclosed in U.S. Pat. No. 8,196,441 to Hendrickson et al., filed Jul. 1, 2008, entitled "Household Cleaning Appliance with a Dispensing System Operable Between a Single Use Dispensing System and a Bulk Dispensing System," U.S. Pat. No. 8,388,695 to Hendrickson et al., filed Jul. 1, 2008, entitled "Apparatus and Method for Controlling Laundering Cycle by Sensing Wash Aid Concentration," U.S. Pat. No. 8,397,328 to Hendrickson et al., filed Jul. 1, 2008, entitled "Apparatus and Method for Controlling Concentration of Wash Aid in Wash Liquid," U.S. Pub. No. 2010/0000581 to Doyle et al., filed Jul. 1, 2008, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pat. No. 8,397,544 to Hendrickson, filed Jun. 23, 2009, entitled "Household Cleaning Appliance with a Single Water Flow Path for Both Non-Bulk and Bulk Dispensing," and U.S. Pat. No. 8,438,881, filed Apr. 25, 2011, entitled "Method and Apparatus for Dispensing Treating Chemistry in a Laundry Treating Appliance," which are herein incorporated by reference in full.

As mentioned, the washing machine 10 may also include a recirculation and drain system for recirculating liquid within the laundry holding system and draining liquid from the washing machine 10. Liquid within the tub 14 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without fabric enhancers, may be recirculated into the treating chamber 18 for treating laundry.

The liquid supply and/or recirculation and drain system may be provided with a heating system that may include one or more devices for heating laundry and/or liquid supplied to the tub 14, such as a steam generator 82 and/or a sump heater 84. This is beneficial at least because certain fabric enhancers have higher efficacies under heated conditions. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the dispensation, supply, and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

Figure 1B:
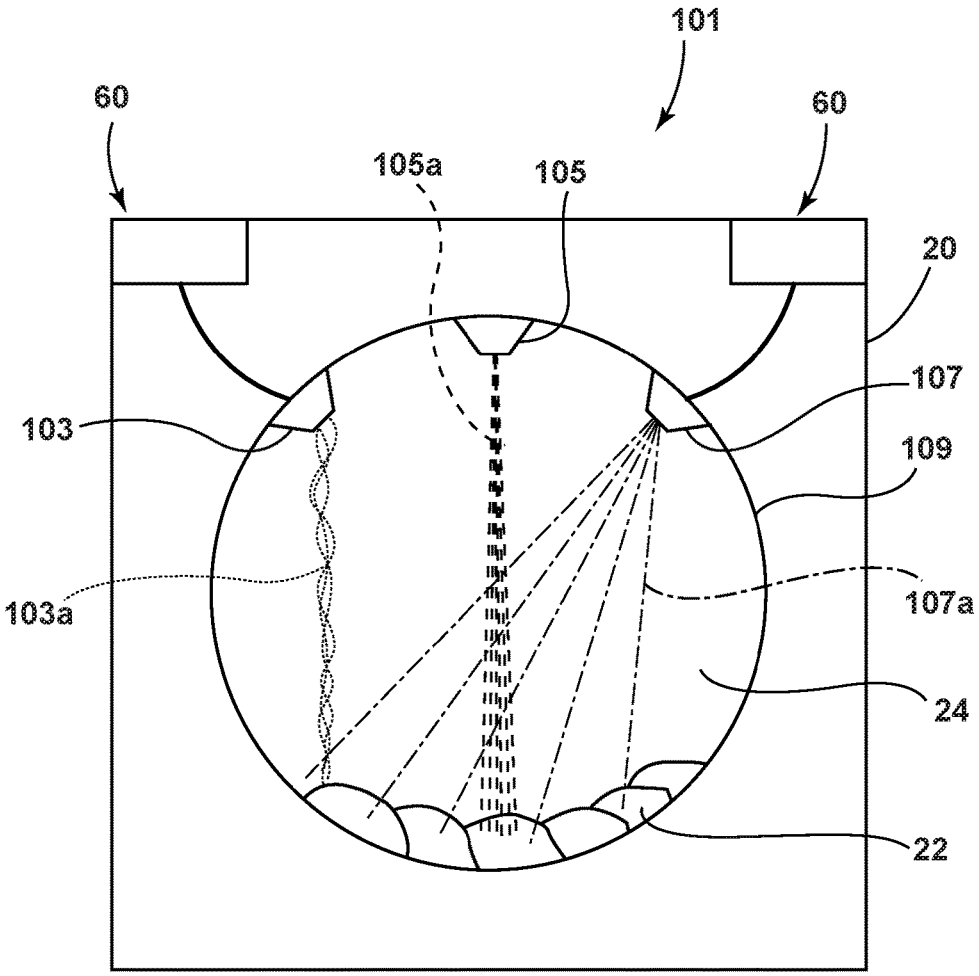
FIG. 1B is a front perspective view of a laundry treating appliance in the form of a horizontal axis washing machine illustrating exemplary nozzle configurations for the fabric enhancer dispensing system in accordance with the present disclosure.

FIG. 1B is a front perspective view of a horizontal axis washing machine 101 similar to the washing machine 10 depicted in FIG. 1A, illustrating exemplary nozzle positions and dispensation patterns through which the fabric enhancer dispensing system 60 can dispense fabric enhancers in accordance with the present disclosure. In the depicted example, the washing machine 101 includes multiple fabric enhancer dispensing systems 60, each capable of storing and pumping different types of fabric enhancers. The fabric enhancer dispensing systems 60 pump fabric enhancers to nozzles 103, 105, and 107. Nozzle 103 is depicted at an 11:00 position relative to a drum 109, nozzle 105 is depicted at a 12:00 position relative to the drum 109, and nozzle 107 is depicted at a 1:00 position relative to the drum 109. However, other numbers of nozzles occupying other angular positions are within the scope of the present disclosure. The nozzles 103, 105, and 107 can be positioned at varying locations along the axial length of its drum. The nozzles 103, 105, and 107 can be pointed in varying directions and can be configured to provide varying flow or spray patterns.

In this example, nozzle 103 dispenses fabric enhancer according to a dispensation pattern 103*a*, nozzle 105 dispenses fabric enhancer according to a dispensation pattern 105*a*, and nozzle 107 dispenses fabric enhancer according to a dispensation pattern 107*a*. Each of dispensation patterns 103*a*, 105*a*, and 107*a* can take on varying forms, depending on the desired treatment of the fabrics. Exemplary dispensation patterns include a periodic dripping, a gravity flow through a non-pressurized stream, a pressurized stream, and/or a conical or fanned spray pattern. In this example, dispensation pattern 103*a* is a non-pressurized stream, dispensation pattern 105*a* is a pressurized stream, and dispensation pattern 107*a* is a conical or fanned spray pattern. The angular spread of conical or fanned spray pattern 107*a* is controlled by the shaping and configuration of the nozzle 107, which can be adjusted by the manufacturer to achieve desired dispensation patterns. Different dispensation patterns may be better suited to respective types of fabric enhancers.

Figure 2A:
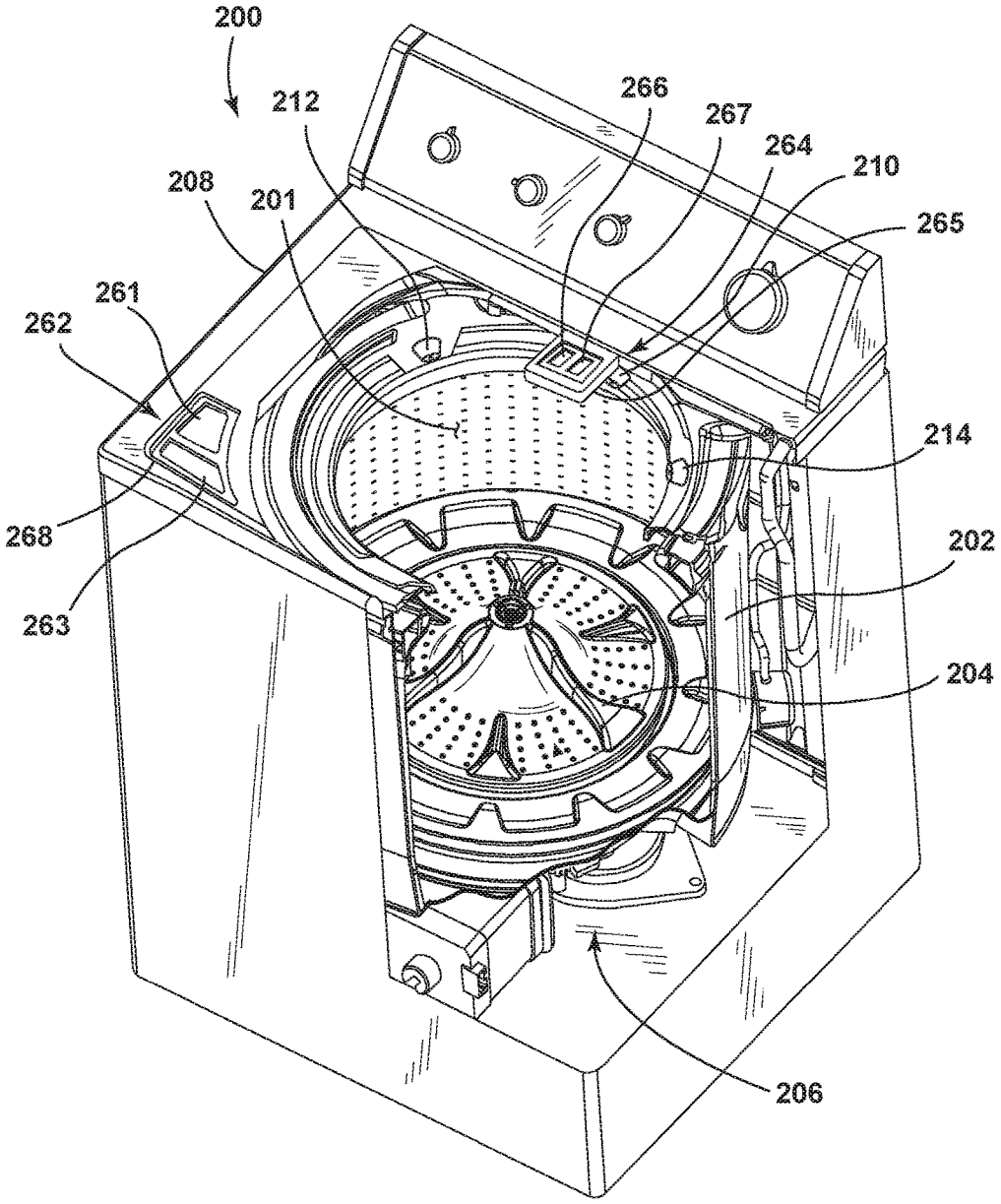
FIG. 2A is a perspective view of a laundry treating appliance in the form of a vertical axis washing machine illustrating alternative locations for a fabric enhancer dispensing system in accordance with the present disclosure.

FIG. 2A is a perspective view of a laundry treating appliance in the form of a vertical axis washing machine 200 illustrating a fabric enhancer dispensing system in accordance with the present disclosure. Vertical axis washing machine 200 includes many functionally similar components as horizontal axis washing machine 10, previously described, except that such components would be configured for a vertical axis implementation. Thus, by way of example, vertical axis washing machine 200 includes a tub 202 for containing wash water, a perforated and rotatable wash basket 201 forming a treating chamber, an impeller 204 for providing movement of laundry and wash water, a drive system 206 for rotating the basket 201 and/or the impeller 204, and a controller (not shown but similar to the controller 96) for controlling operations of the washing machine 200.

The washing machine 200 includes fabric enhancer dispensing systems 262, 264, which are similar in structure and operation to the fabric enhancer dispensing system 60 shown in FIG. 1A. In particular, fabric enhancer dispensing systems 262, 264 also include respective fabric enhancer storage assemblies 261, 266, and pump assemblies 263, 267, for storing and pumping fabric enhancers. As with the fabric enhancer dispensing system 60, the fabric enhancer dispensing systems 262, 264 can be provided according to various implementations, including as separate modules within the washing machine 200 or external to the washing machine 200.

FIG. 2A shows exemplary placement locations for fabric enhancer dispensing systems in connection with vertical axis washing machines. In the illustrated example, the fabric enhancer dispensing system 262 is provided in a tray 268 disposed within an upper frame member 208. The tray 268 is exposed when a user opens a lid (not shown) of the washing machine 200. Fabric enhancer dispensing system 264, in contrast, is provided in a retractable pull-out drawer 265, and is exposed when a user pulls out the pull-out drawer 265.

In the illustrated implementation, fabric enhancer dispensing systems 262, 264 pump fabric enhancers (either alone or mixed with water) through conduits (not shown) that terminate in nozzles 210, 212, 214. As with nozzles 103, 105, and 107 shown in FIG. 1B, the nozzles 210, 212, and 214 can dispense fabric enhancers according to any dispensation pattern suitable for the fabric enhancer and wash cycle operation at hand.

Figure 2B:
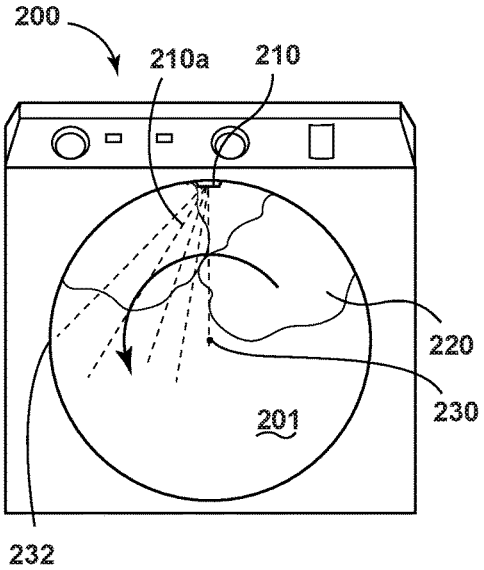
FIG. 2B is a plan view of a vertical axis washing machine illustrating an alternative spray pattern for fabric enhancer dispensation in accordance with the present disclosure.
Figure 2C:
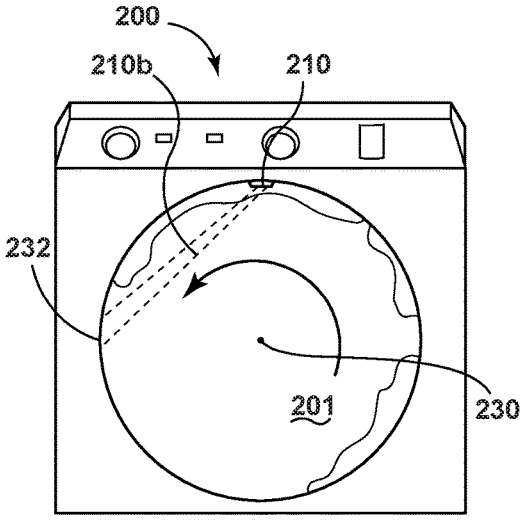
FIG. 2C is a plan view of a vertical axis washing machine illustrating an alternative spray pattern for fabric enhancer dispensation in accordance with the present disclosure.
Figure 2D:
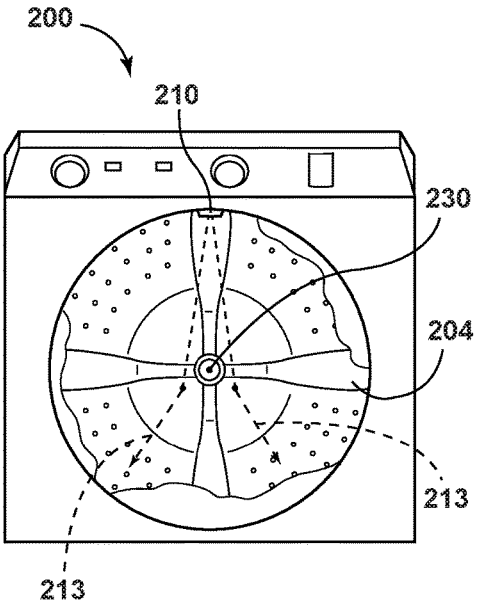
FIG. 2D is a plan view of a vertical axis washing machine illustrating an illustrating an alternative spray pattern for fabric enhancer dispensation in accordance with the present disclosure.

FIG. 2B, FIG. 2C, and FIG. 2D illustrate exemplary dispensation patterns that may be suitable for different respective scenarios. FIG. 2B shows a plan view of the washing machine 200 during a wash cycle operation in which the basket 201 and/or impeller 204 (not shown in FIG. 2B) are being driven such that the laundry load 220 rotates around a central axis 230 at a relatively low RPM. At a relatively low RMP, the laundry load 220 remains in an expanded (non-satellized) state and occupies a substantial portion of the space at the base of the basket 201. The nozzle 210 dispenses fabric enhancer according to a fanned distribution pattern 210*a*, with the angular extent of the fan spanning from the central axis 230 to a position at the outer circumference 232 of the base of the basket 201. By assuming a fanned dispensation pattern of this type, a substantial surface area of the laundry load 220 will be contacted by the fabric enhancer during each rotation of the laundry load 220.

FIG. 2C shows a plan view of the washing machine 200 during a wash cycle operation in which the basket 201 is driven at a high enough RPM such that the laundry load 220 has satellized. Here, the nozzle 210 dispenses fabric enhancer in a focused, pressurized stream targeting the outer circumference 232 of the basket 201. Such a dispensation pattern may be appropriate where it is desired to achieve direct contact between the fabric enhancer and the laundry load 220 while the laundry load is satellized.

FIG. 2D shows a dispensation pattern 210*c* in which the fabric enhancer is dispensed towards the center of the impeller 204. Here again, the laundry load 220 is depicted in a satellized state while the basket 201 rotates at a rapid rate. Dispensation pattern 210*c* may be advantageous because the fabric enhancer dispensed towards the center of the impeller 204 will be pulled outwards, as suggested by path 213, owing to the centrifugal forces operating within the rapidly spinning basket 201. This will result in the fabric enhancer treating chemistry being pulled through the laundry fabrics for enhanced uniformity of distribution.

Figure 2E:
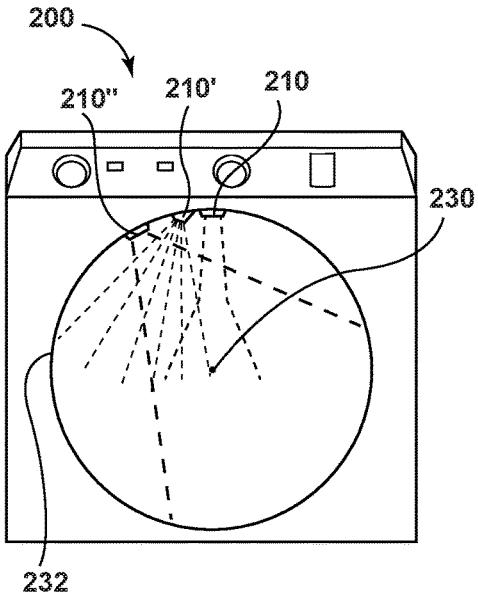
FIG. 2E is a plan view of a vertical axis washing machine illustrating an alternative spray pattern for fabric enhancer dispensation in accordance with the present disclosure.

FIG. 2E shows an implementation that includes three nozzles 210, 210', 210". In this example, nozzle 210 dispenses a first type of fabric enhancer, nozzle 210' dispenses a second type of fabric enhancer, and nozzle 210" is a fresh fill water nozzle. In exemplary usages, the first type of fabric enhancer may be a fabric softener and the second type of fabric enhancer may be a detergent, but any other fabric enhancers (including any others mentioned in this application) are within the scope of the present disclosure.

The fresh fill nozzle 210" sprays a sheet of water that may target a basket wall. This may knock down fabric enhancers built up on the basket wall (e.g., due to recirculation and/or clothes being plastered to the wall during spins). The fabric enhancer nozzle 210 dispenses from the outer circumference 232 to the central axis 230, which may be particularly well suited to enable uniform distribution during low spin. The fabric enhancer nozzle 210' dispenses fabric enhancer by targeting the central axis 230 of the basket, which may be particularly well suited to enable uniform distribution during high spins and/or for dispensation directly into the water during deep fill rinses.

In exemplary implementations, the nozzles 210, 210', and 210" direct their spray patterns towards the base or bottom of the basket, as excessive spray against the side walls of the basket may cause damage or corrosion to the side walls.

Figure 3:
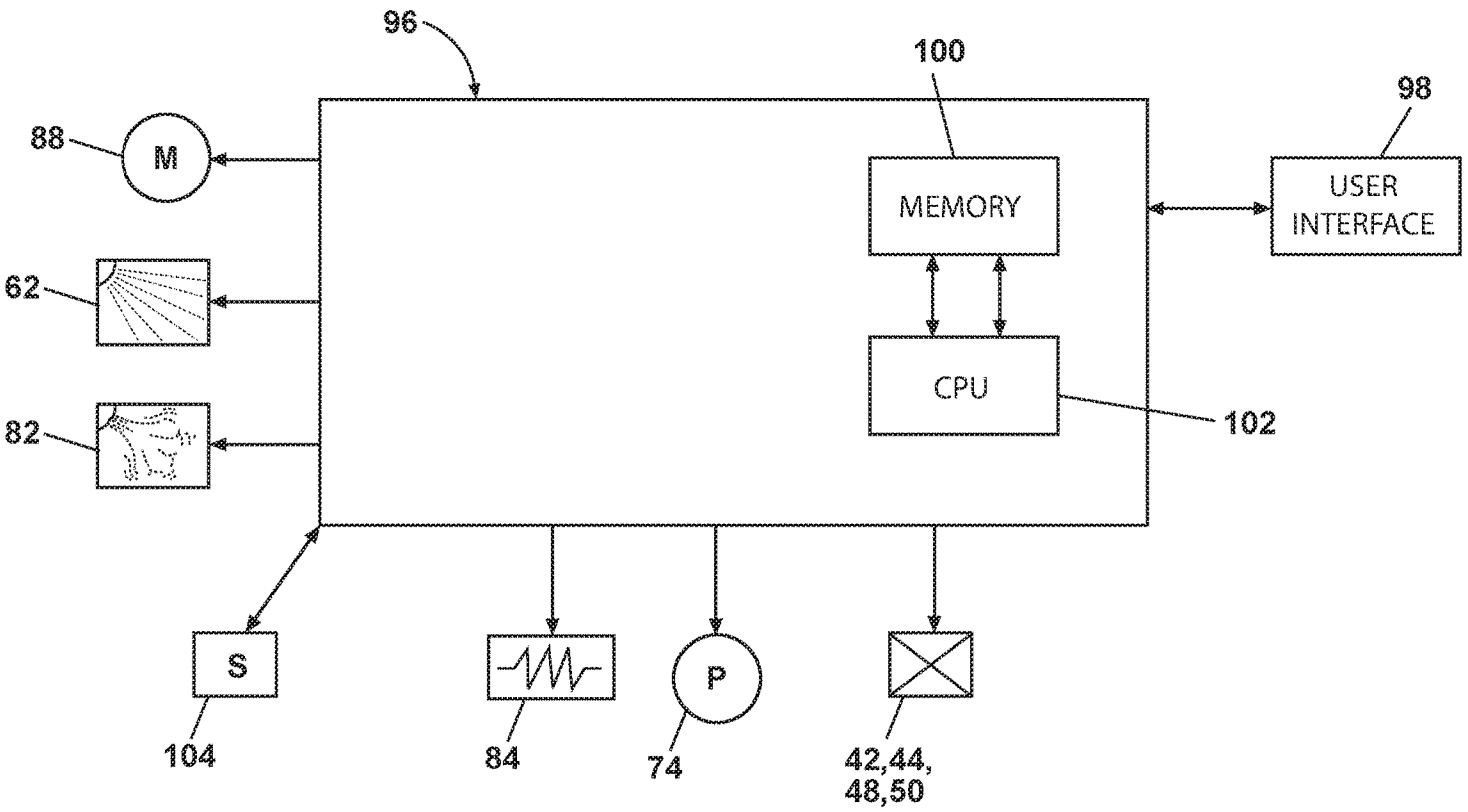
FIG. 3 is a schematic view of a control system for laundry treating appliances in accordance with the present disclosure.

As illustrated in FIG. 3, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. For example, the memory 100 may be used to store a plurality of drum or basket acceleration ramp profiles for respective ones of a plurality of ball balancing ring fluid viscosities. The database or table may also be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62 (including its fabric enhancer storage assembly 61 and pump assembly 63), the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, a load position sensor, a ball balancing ring ball position sensor, a motor temperature sensor, and a motor torque sensor, which may be used to determine a variety of system and laundry characteristics, such as ball balancing ring 38 temperature, ball balancing ring ball position(s), load position and/or laundry load inertia or mass.

Figure 4A:
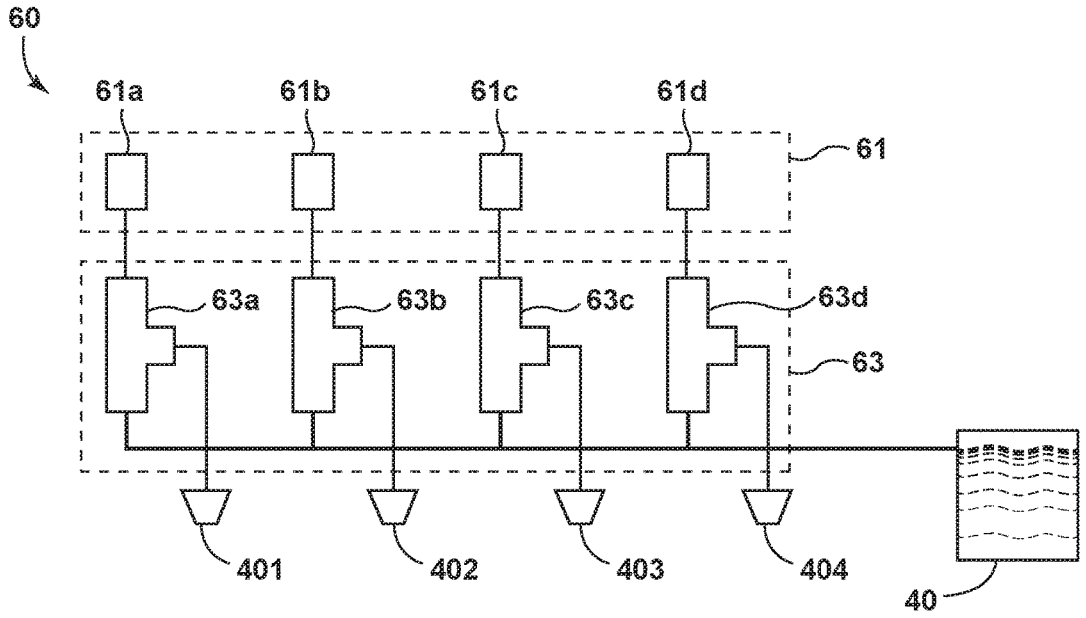
FIG. 4A is a schematic view of an alternative way in which fabric enhancers, water pressure pumps, selectively actuatable fluidic valves, and nozzles can be configured to selectively dispense one or more fabric enhancers onto a laundry load.
Figure 4B:
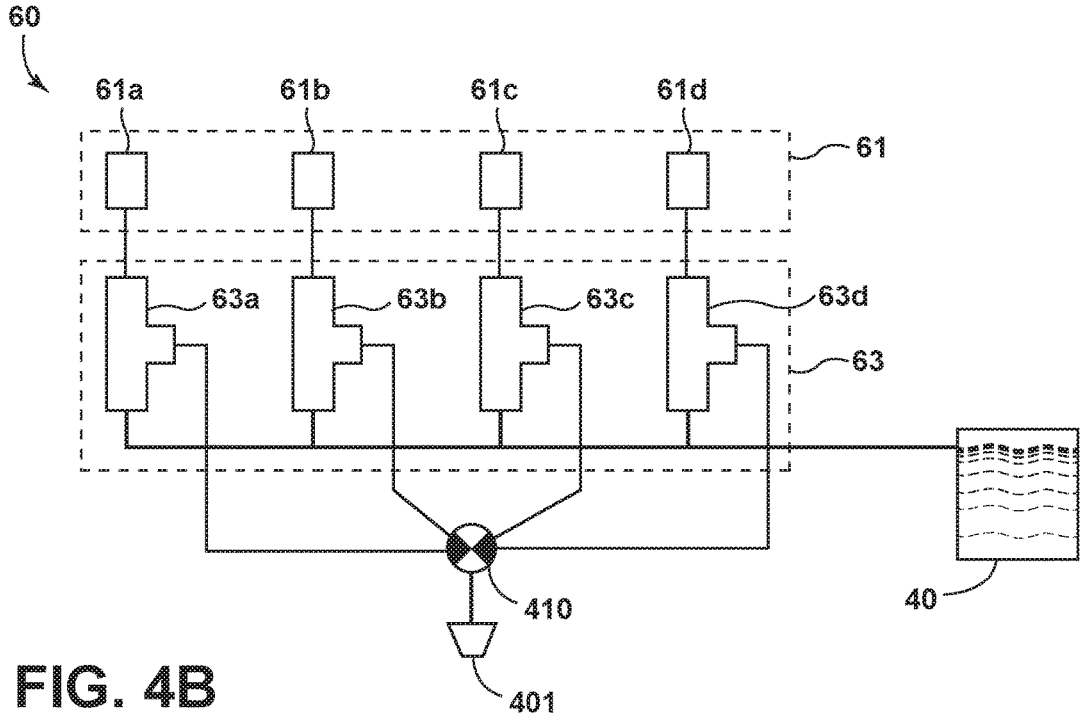
FIG. 4B is a schematic view of an alternative way in which fabric enhancers, water pressure pumps, selectively actuatable fluidic valves, and nozzles can be configured to selectively dispense one or more fabric enhancers onto a laundry load.
Figure 4C:
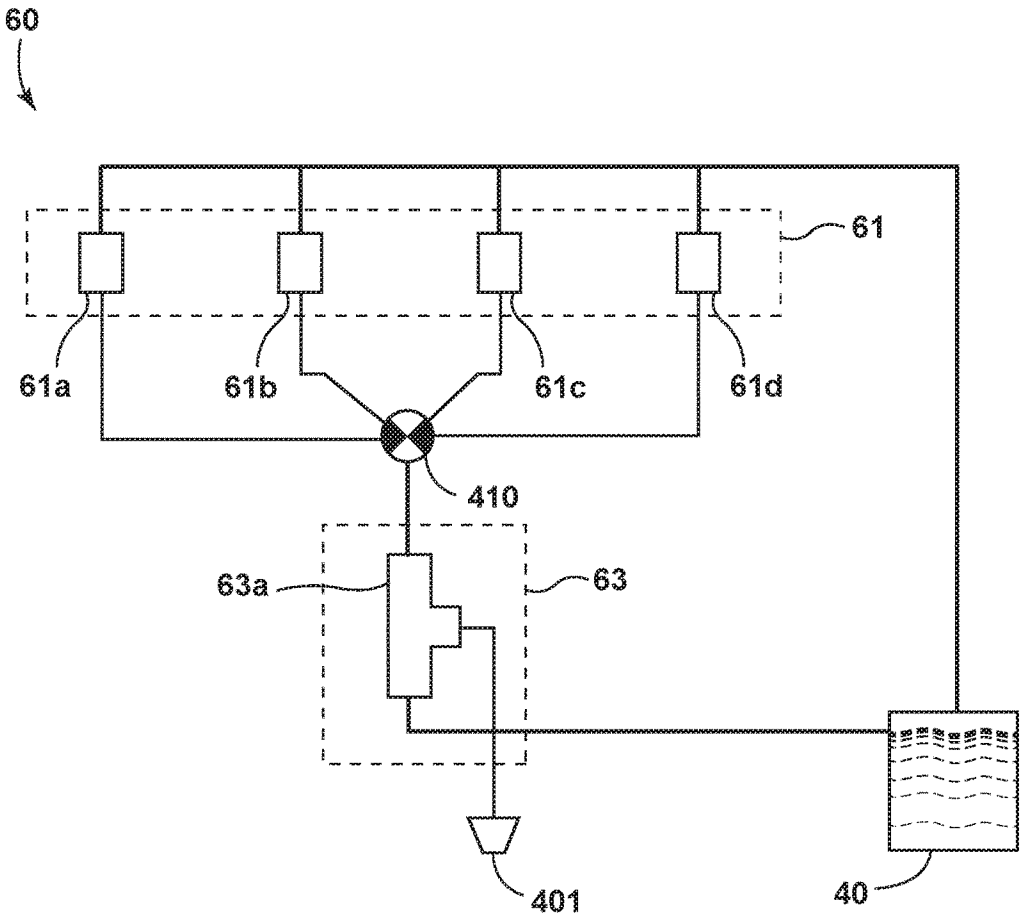
FIG. 4C is a schematic view of an alternative way in which fabric enhancers, water pressure pumps, selectively actuatable fluidic valves, and nozzles can be configured to selectively dispense one or more fabric enhancers onto a laundry load.

FIGS. 4A-4C show alternative schematic configurations of fabric enhancer dispensing system 60, including different manners by which fabric enhancer storage assembly 61, pump assembly 63, and one or more nozzles can be fluidically coupled. FIG. 4A shows the fabric enhancer storage assembly 61 containing the fabric enhancer compartments 61*a-d*. Each of the fabric enhancer compartments 61*a-d* is fluidically coupled to a respective pump 63*a-d*. Each of the pumps 63*a-d* are also fluidically connected to the water supply 40. Each of the pumps 63*a-d* has an outlet that terminates at a respective nozzle 401, 402, 403, 404. Thus, in this illustrative example, there is a dedicated nozzle 401, 402, 403, or 404 for each of the types of fabric enhancers stored in the compartments 61*a-d*.

FIG. 4B shows an alternative implementation that uses just one nozzle 401. Here, instead of each of the pumps 63*a-d* coupling to a respective nozzle 401-404, the dispensing system 60 includes a valve 410. The valve 410 allows fabric enhancer flow paths to converge and flow to the nozzle 401 for dispensation. In certain implementations, each of the pumps 63*a-d* are selectively actuated such that one or more desired fabric enhancers flow through the valve 410 to the nozzle 401 at any given time. In other implementations, the valve itself is selectively actuable (e.g., controlled by the controller 96) to allow fabric enhancer to enter valve inlets from one or more of the pumps 63*a-d*, as desired, at any given time.

FIG. 4C shows an alternative implementation that uses just one pump 63*a* and one nozzle 401. Here, the valve 410 fluidically couples directly with the compartments 61*a-d*, allowing one or more of the fabric enhancers stored in the compartments 61*a-d* to flow through to the pump 63*a*. The pump 63*a* then pumps the fabric enhancer to the nozzle 401 for dispensation. Here again, the valve 410 may be selectively actuatable to provide control over which of the fabric enhancers in the compartments 61*a-d* are pumped and dispensed at any given time.

FIG. 4C also shows that the water supply 40 can optionally be coupled to the compartments 61*a-c*. Though depicted in connection with FIG. 4C, this may be true of any embodiment. When coupled with water supply 40, a pressurized water stream may flow through the storage compartments 61*a-d* to aid in the flow of fabric enhancer. As will be explained in more detail below, the water flowing through the storage compartments 61*a-d* may be of a predetermined temperature that pretreats the fabric enhancer, with hot water providing particular benefits for many types of fabric enhancer.

Having discussed exemplary dispensing systems and components that improve the uniformity with which fabric enhancers are distributed, FIGS. 5-8 depict exemplary wash cycle operations that improve uniformity of distribution. These wash cycle operations can be utilized in connection with any of the above-described systems and components.

Figure 5:
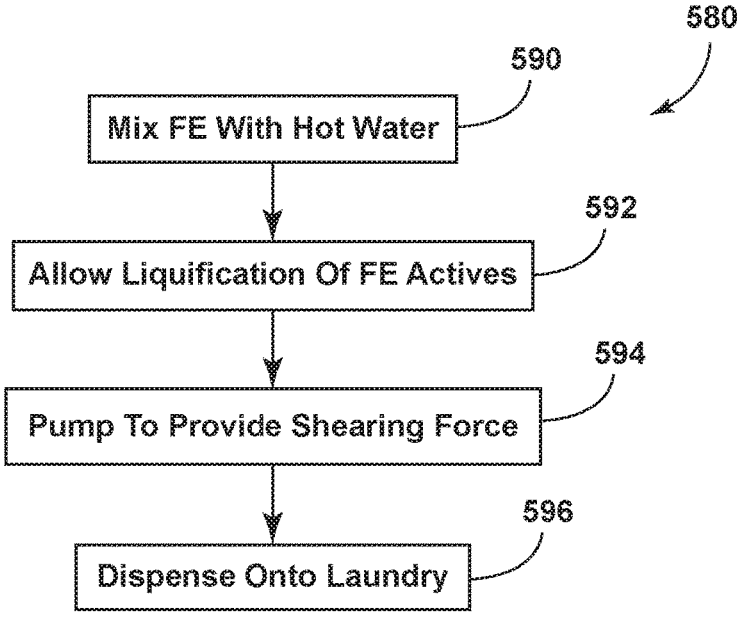
FIG. 5 is a flow diagram illustrating a method of dispensing fabric enhancers in accordance with the present disclosure in which fabric enhancers are pre-exposed to hot water before dispensation.

FIG. 5 is a flow diagram showing a method 580 that the applicants have found to be particularly well suited for uniform distribution of fabric enhancer, particularly when using a water pressure pump of the type set forth in the '529 application. According to this methodology, fabric enhancers are pre-exposed to hot water before dispensation, which has been found to greatly improve the resulting uniformity of fabric enhancer distribution.

The method of operation 580 begins with a mixing step 590, in which fabric enhancers are pre-mixed with hot water. As already explained above, there are a variety of ways in which fabric enhancers can be pre-mixed with water. For example, with reference to FIG. 1 and FIG. 4C, water from the water supply 40 may flow into compartments 61*a-d* of the fabric enhancer storage assembly 61 before the resulting mixture of fabric enhancer and water flows to the pump assembly 63. Alternatively, the washing machine 10 may have separate mixing chambers into which different types of fabric enhancers and/or water can be pre-mixed to form a wash liquor that is ultimately provided to the pump assembly 63. Any suitable structure for a mixing chamber can be used, such as those disclosed in U.S. Pat. No. 8,047,024, entitled "Control and wash cycle for activation and deactivation of chemistry in the wash bath of an automatic washer," which is incorporated by reference herein in its entirety.

The fabric enhancer is mixed with hot water, preferably between about 40° C. and about 60° C., and for particular applications above 50° C. A suitable volume of water may be approximately 2-3 times the volume of the fabric enhancer.

The method of operation 580 proceeds to step 592, in which the hot water liquefies the active ingredients of the fabric enhancer, enhancing solubility of fatty materials within the mixture. In step 594, the resulting chemistry is optionally pumped through the pump assembly 63, which provides shearing forces that break apart amalgamations, vesicles, and lyotropic liquid crystal structures. The resulting chemistry is then dispensed onto the laundry load in step 596. The pre-mixing with hot water, even if done with a relatively small volume of water and for a relatively short amount of time, has been found by the applicants to provide significant benefits in uniformity of fabric enhancer distribution.

Figure 6:
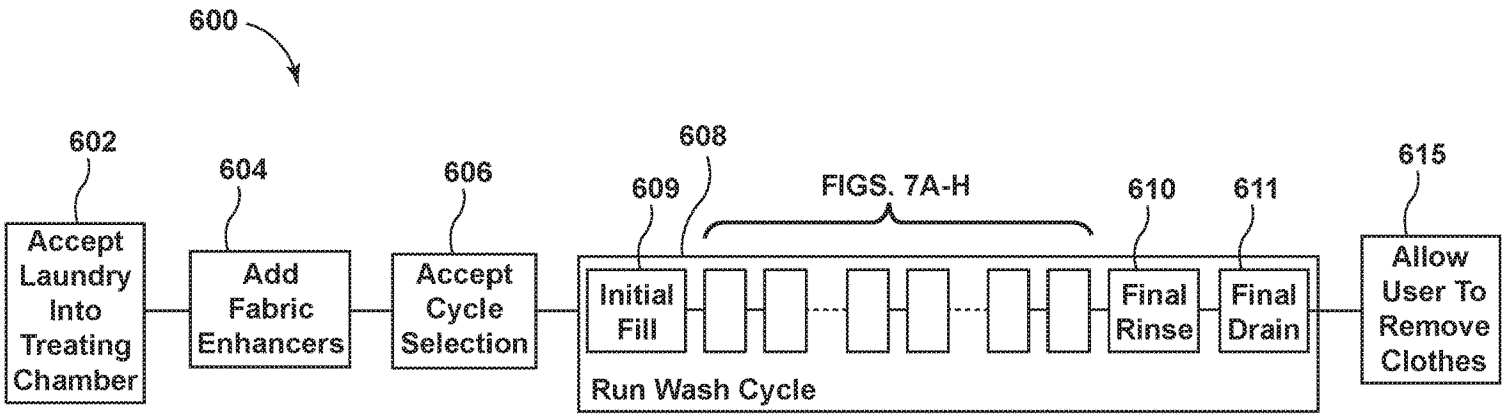
FIG. 6 is a flow chart for a method of operation of a laundry treating appliance illustrating that a wash cycle may include multiple operational phases, among which are operational phases in which fabric enhancers are dispensed in accordance with the present disclosure.

FIG. 6 is a flow diagram showing an exemplary method of operation 600 for using washing machines equipped with the fabric enhancer dispensing system 60, and FIGS. 7A-G are flow diagrams illustrating exemplary fabric enhancer dispensing operational phases that may be part of the method of operation 600. Certain illustrative explanations in connection with FIG. 6 and FIGS. 7A-G will be provided with reference to the horizontal axis washing machine 10 of FIG. 1A, and others will be provided with reference to the vertical axis washing machine 200 of FIG. 2A, but it should be understood that the methodologies set forth below can be used in connection with horizontal axis or vertical axis washing machines.

The method of operation 600 begins with an accepting step 602, in which the washing machine 10 accepts laundry into its drum 16 or basket 201 (e.g., by unlocking a door or hatch and allowing a user to place laundry within the machine 10, 200). The method of operation 600 proceeds to an adding step 604, in which fabric enhancers can be added into the compartments 61*a-d*. The method of operation 600 continues to an accepting step 606, in which the washing machine 10, 200 accepts a wash cycle selection from a user via the user interface 98.

The method of operation 600 then proceeds to a washing step 608, in which the washing machine 10, 200 runs the selected wash cycle. The operational phases through which the washing machine 10, 200 will proceed during the wash cycle will vary based on the selected wash cycle. By way of example, the selected wash cycle may begin with an initial fill operation 609 and conclude with final rinse and drain operations 610, 611. Between these operations, the washing machine 10, 200 may proceed through a variety of operational phases, which may include fill operations, drain operations, drum spin operations, impeller spin operations, fresh water fill operations, rinse operations, and dispense operations.

Among the operational phases that may be performed, the applicants have identified certain sequences of operations that substantially enhance distribution uniformity of fabric enhancers on the laundry load. Examples of such operational phases are set forth in FIGS. 7A-7G.

Figure 7A:
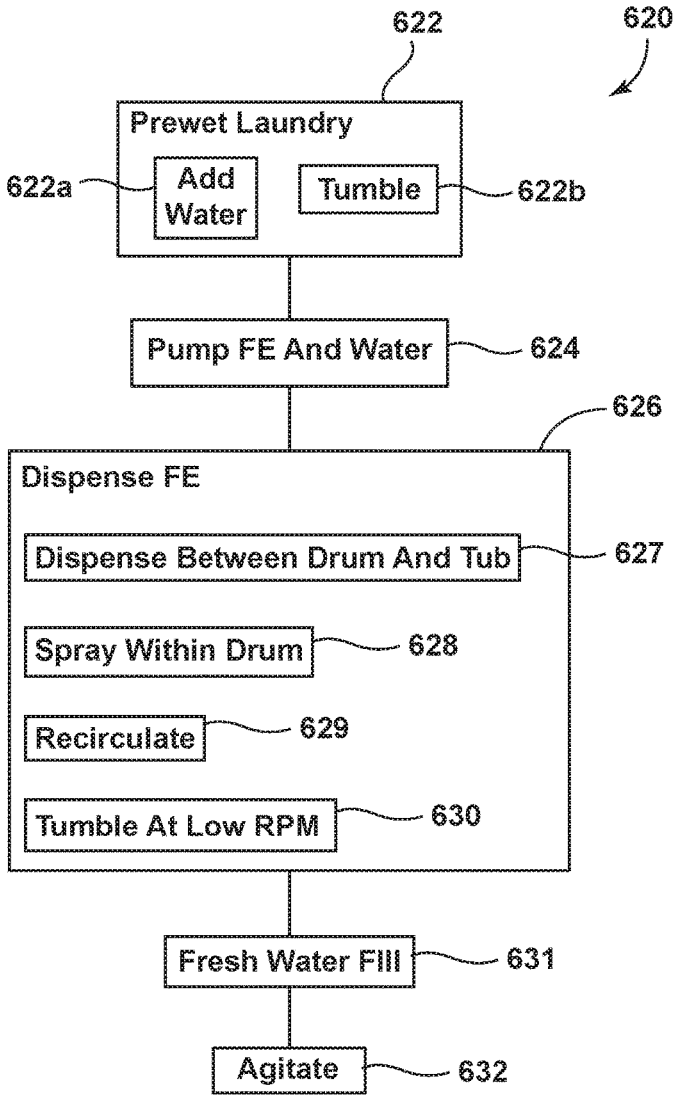
FIG. 7A is an illustrative example of fabric enhancer dispensing operational phases that can be used alone or in combination in order to dispense fabric enhancers in accordance with the present disclosure.

FIG. 7A is a flow diagram for an operational phase 620 that improves uniformity of fabric enhancer distribution. Operational phase 620 can be used for both vertical axis and horizontal axis washing machines, but the applicants have found that it is particularly well suited for providing distribution uniformity in horizontal axis washing machines. In illustrative embodiments, uniform distribution of chemistry can be promoted by distributing fabric enhancers are certain residual moisture content (RMC) values. Thus, operational phase 620 begins with a prewetting step 622. During prewetting step 622, the laundry load is wetted to a residual moisture content (RMC) of greater than 30%, and preferably between 30% and 50%. However, if method of operational 600 is performed at the end of an extraction cycle, an RMC of greater than 50% may be expected and is in accordance with the present disclosure. Prewetting step 622 may include an adding water step 622*a* and, optionally, a tumbling step 622*b*.

Operational phase 620 proceeds to pumping step 624, in which fabric enhancer is pumped through one or more pumps in the pump assembly 63. Where the pumps are water pressure pumps as described in the '529 application, the pump assembly 63 creates a high shear force that allows disintegration of liquid crystal (i.e., vesicle) structures. The fabric enhancer can be mixed with incoming water from the water supply 40 as it is pumped through the pump assembly, as previously explained. The pumps in the pump assembly 63 can dispense accurate amounts of fabric enhancer at selectively different and/or variable concentrations, as explained more fully in the '529 application. As such, an optimal or near-optimal concentration for a solution containing the fabric enhancer and water can be used. Generally, the optimal concentration of this solution will be a function of various factors, including the active ingredient in the fabric enhancer. By way of example, the applicants have determined that a suitable concentration for conventional fabric softeners may be 4% or less, and other types of fabric enhancers may have other preferred concentrations.

Operational phase 620 proceeds to dispensing step 626, in which fabric enhancer is dispensed into the treating chamber 18. Dispensing step 626 may include one or more steps, which can be used alone or in any combination. Specifically, dispensing step 626 may include a dispensing step 627 in which fabric enhancers are dispensed between the drum 16 and the tub 14 (e.g., via the nozzle 66*a*). Dispensing step 626 may also include a spraying step 628, in which fabric enhancers are sprayed into the drum 16 (e.g., via the nozzle 66*b*). In illustrative embodiments, uniform distribution of chemistry can be prompted by distributing fabric enhancer at particular RPMs. In this example, spraying step 628 can occur while the drum 16 rotates at a low RPM, but the applicants have found that there may be benefits in performing the spraying step while the drum 16 rotates at a high RPM while the laundry load is satellized, such that the fabric enhancer solution is sprayed in a middle of the load and can be uniformly pulled through the load while satellized. Dispensing operation 626 may also include a recirculating step 629, in which water that contains dispensed fabric enhancer is recirculated into the treating chamber 18 using the recirculation system of the washing machine 10. Finally, dispensing step 626 may also include a tumbling step 630, in which—subsequent to spraying of the fabric enhancers—the drum 16 is spun at a low RPM to tumble the laundry load below the satellization speed.

Steps 622, 624, and 626 can optionally be repeated multiple times for multiple types of fabric enhancers. As such, multiple layers of fabric enhancer additives may become deposited onto fabrics, resulting in a build-up of multiple layers of fabric enhancer. To further improve uniformity of distribution, operational phase 620 includes a filling step 631 and an agitating step 632. In step 631, a fresh water fill is performed and in step 632, the laundry load is agitated. This has the effect of "knocking down" the multilayer build-up of fabric enhancer on the laundry, better distributing the fabric enhancer throughout the laundry load.

Figure 7B:
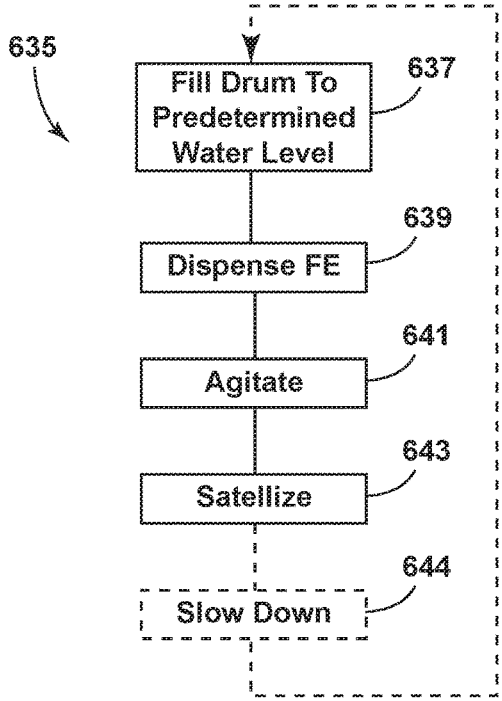
FIG. 7B is an illustrative example of fabric enhancer dispensing operational phases that can be used alone or in combination in order to dispense fabric enhancers in accordance with the present disclosure.

FIG. 7B shows an operational phase 635 that improves uniformity of fabric enhancer distribution. Operational phase 635 is suitable for either horizontal axis or vertical axis washing machines, but will be described in the context of the vertical axis washing machine 200. In illustrative embodiments, uniform distribution of chemistry is promoted by distributing chemistry when the washing machine achieves a particular water level. Thus, operational phase 635 begins with a filling step 637, in which the basket 201 is filled to a predetermined water level. In exemplary implementations, the predetermined water level is selected to be the water level used for COLORLAST® wash cycles used in washing machines offered by WHIRLPOOL® CORP., of Benton Harbor, Mich.

Operational phase 635 proceeds to dispensing step 639, in which fabric enhancer is dispensed by being pumped through the dispensing systems 262, 264. In one implementation, the fabric enhancer is sprayed through one of the nozzles 210, 212, 214 towards the center of the basket 201 (e.g., near a hub region of the impeller 204). The applicants have found that waiting until the water is filled to a predetermined level before adding fabric enhancer can provide substantial benefits for uniformity of fabric enhancer distribution, particularly when used with water pressure pumps of the type described in the '529 application. In exemplary implementations, fabric enhancers are dispensed into the water at the predetermined water level as opposed to directly on the impeller, which provides the benefit of allowing the sheered and diluted vesicles to diffuse and migrate quickly throughout the solutions and be recirculated onto the walls of the basket or soaked up through the clothes.

Operational phase 635 proceeds to an agitating step 641, in which the laundry load is agitated (e.g. through movement of the impeller 204 and/or the basket 201). Finally, operational phase 625 can proceed to a satellization step 643, in which the basket 201 is spun at a sufficiently high speed (e.g., 75-100 RPM) such that the laundry load is satellized. Fabric enhancer can continue to be dispensed during agitating step 641 and satellizing step 643. Satellizing generally refers to having the laundry load pressed against the basket walls using centrifugal force from basket rotation.

Depending on the type of laundry load, the laundry may soak up water, causing the water level to drop below the predetermined water level. In exemplary implementations, additional water is then added to bring the water level back up to the predetermined water level. Additional fabric enhancer may then be dispensed to maintain a uniform concentration of fabric enhancer within the soak environment. For example, for a predetermined water level of 140 mmwc (i.e., water column height in millimeters), 7 dispensations of fabric enhancer may be dispensed from a water pressure pump. If the laundry load soaks up water such that the water level drops to 120 mmwc, then additional water corresponding to 20 mmwc may be added, along with one additional dispensation of fabric enhancer from the water pressure pump.

During the satelization step 643, the rapid spinning of the basket may create a vortex, lifting of the water along the cavity between the basket and tub. Optionally, a slowing step 644 may be performed. This may cause the raised water to flush into the basket from the outside, wetting the clothes at higher portions along the sidewall of the basket. Repeating these steps of operational phase 635 may provide uniform distribution of fabric enhancer while keeping water levels low and still providing fabric enhancer contact to the garments located in higher regions along the basket walls.

Figure 7C:
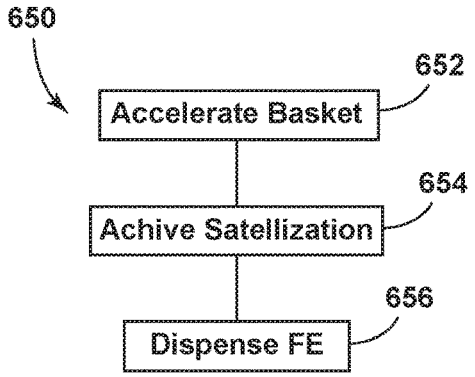
FIG. 7C is an illustrative example of fabric enhancer dispensing operational phases that can be used alone or in combination in order to dispense fabric enhancers in accordance with the present disclosure.

FIG. 7C shows an operational phase 650 that improves uniformity of fabric enhancer distribution. Operational phase 650 includes an accelerating step 652, in which the basket 201 is accelerated. In step 654, the basket 201 achieves satellization speed (e.g., 75-100 RPM), such that the laundry load is satellized up against a circumferential wall of the basket 201. Finally, in dispensing step 656, fabric enhancer is dispensed. Preferably, the fabric enhancer is dispensed into the center of the basket 201, such as onto the impeller 204. The fabric enhancer dispensed onto the impeller 204 will be pulled outwards owing to the centrifugal forces operating within the rapidly spinning basket 201 (see, e.g., FIG. 2D), and will result in the fabric enhancer being pulled through the clothing, including interstitial fibers of the laundry fabrics. Spinning at a high RPM has the additional advantage of preventing garments from falling off of the basket sidewall and blocking the impeller. Thus, the fabric enhancers have a clear path to the impeller region, after which the fabric enhancer can migrate through the load. This provides enhanced uniformity of distribution and improved fabric penetration.

Figure 7D:
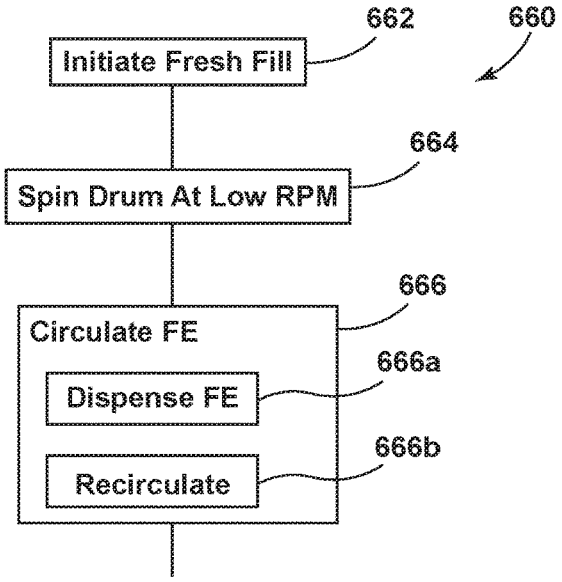
FIG. 7D is an illustrative example of fabric enhancer dispensing operational phases that can be used alone or in combination in order to dispense fabric enhancers in accordance with the present disclosure.

FIG. 7D shows an operational phase 660 that improves uniformity of fabric enhancer distribution. Operational phase 660 includes a fresh fill step 662, in which a fresh water fill is initiated within the basket 201. While running the fresh water fill, in step 664 the basket 201 is spun at a low RPM. The combination of the fresh fill and low RPM spin helps to create a soak environment.

In step 666, fabric enhancer is circulated within the basket 201. Preferably, fabric enhancer is added through two sources. First, in step 666*a*, fabric enhancer is dispensed through the dispensing systems 262, 264. Second, in step 666*b*, the recirculation system of the washing machine 200 is activated, such that a wash liquor containing previously dispensed fabric enhancer can be recirculated onto a laundry load. This provides the advantage of allowing fabric enhancer to dispense onto an enhanced coverage area with the basket 201, enhancing uniformity of dispensation. In particular, the recirculation system may dispense recirculated fabric enhancer within a particular location within the basket 201, and the nozzles 210, 212, and 214 may dispense at alternative locations, such that the combination of initial dispensation and recirculation provides enhanced coverage.

In exemplary implementations, the fresh water fill of step 662 continues while the recirculating step 666*b* proceeds. Dispensing water while recirculating enables the washing machine to raise the RMS of the laundry while keeping water levels low. The result is dispensation of fabric enhancer onto a properly soaked load, while maintaining low water level. As will be explained below, certain types of fabric enhancers are more effective when dispensed in low water levels, making operational phase 660 particularly advantageous for fabric enhancer dispensation. During these steps, fabric enhancer may collect within the soak environment.

In one exemplary cycle, after the steps of FIG. 7D are completed, more water is sprayed within the soak environment and the steps of FIG. 7C are performed. This allows for continuous and uniform application of fabric enhancers, while preventing the build-up of concentrated fabric enhancer in specific pockets of laundry.

Figure 7E:
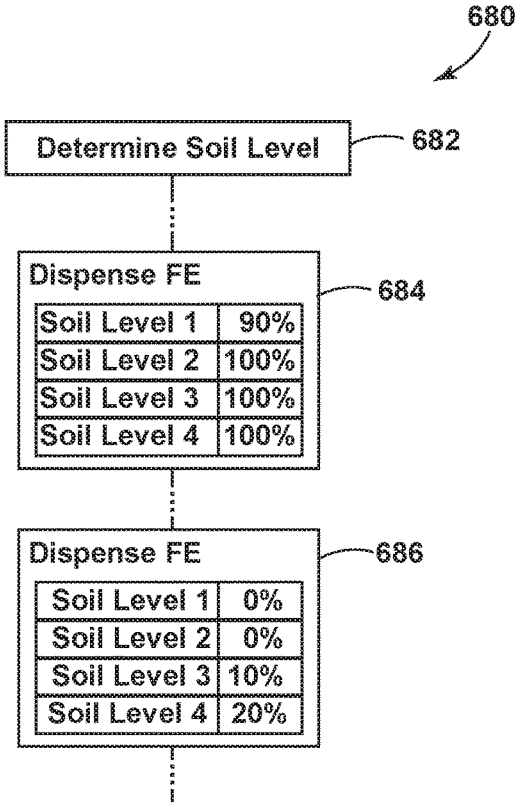
FIG. 7E is an illustrative example of fabric enhancer dispensing operational phases that can be used alone or in combination in order to dispense fabric enhancers in accordance with the present disclosure.

FIG. 7E shows an operational phase 680 in which the amount of fabric enhancer dispensed is adaptively selected based on a condition of the laundry load. In this illustrative example, the fabric enhancer is a soil releasing agent, and the condition of the laundry load is its soil level. A soil level can be input by a user through a user interface (e.g., the user interface 98), or can be detected by the washing machine 200 using sensors. In this illustration, the soil level is represented by four discrete levels, with soil level 1 representing a relatively low amount of soil, soil level 4 representing a relatively high amount of soil, and soil levels 2 and 3 representing respective intermediate amounts of soil.

Operational phase 680 begins with a determining step 682, in which a soil level of the laundry is determined. As explained, this can be accomplished by enabling a user to select a soil level or through automated sensing mechanisms. After other wash cycle operations take place (not shown), operational phase 680 proceeds to dispensing operation 684.

In dispensing operation 684, the dispensing system 262 dispenses an amount of fabric enhancer that is adaptively selected based on a soil level of the laundry. The washing machine 200 is pre-programmed with a default dispensation quantity for the fabric enhancer. In this example, for soil level 1, the dispensing system 262 dispenses 90% of the default dispensation quantity. For soil levels 2, 3, or 4, the dispensing system 262 dispenses the full amount of the default dispensation quantity.

After a period of time in which additional wash cycle operations (not shown) are performed, operational phase 680 proceeds to a boosting step 686, in which a booster quantity of fabric enhancer is dispensed based on a soil level of the laundry. In this example, for soil level 3 the dispensing system 262 dispenses a boost of approximately 10% of the default dispensation quantity, and for soil level 4, the dispensing system 262 dispenses a boost of approximately 20% of the default dispensation quantity.

Although FIG. 7E was explained with reference to soil level, other types of laundry conditions and other types of fabric enhancers can make use of the disclosed boost functionality. For example, a user may specify the required amount of whitening agent, color fidelity agent, UV protectant, stain repellant, shape management agent, anti-microbial, or the like that the user desires or that the laundry load requires. Based on this information, appropriate boost operations can be used throughout a wash cycle to dispense additional quantities of fabric enhancer.

More generally, other implementations in which fabric enhancers are not distributed at one fixed point during the cycle or moment but introduced dynamically are within the scope of the present disclosure. The timing of multiple dispensations can be based on feedback of the torque on the motor or based on water level. For example, by dispensing during periods of higher torque when clothing is plastered against the basket sidewall, fabric enhancer can migrate through the garments and recirculate onto the garments.

Figure 7F:
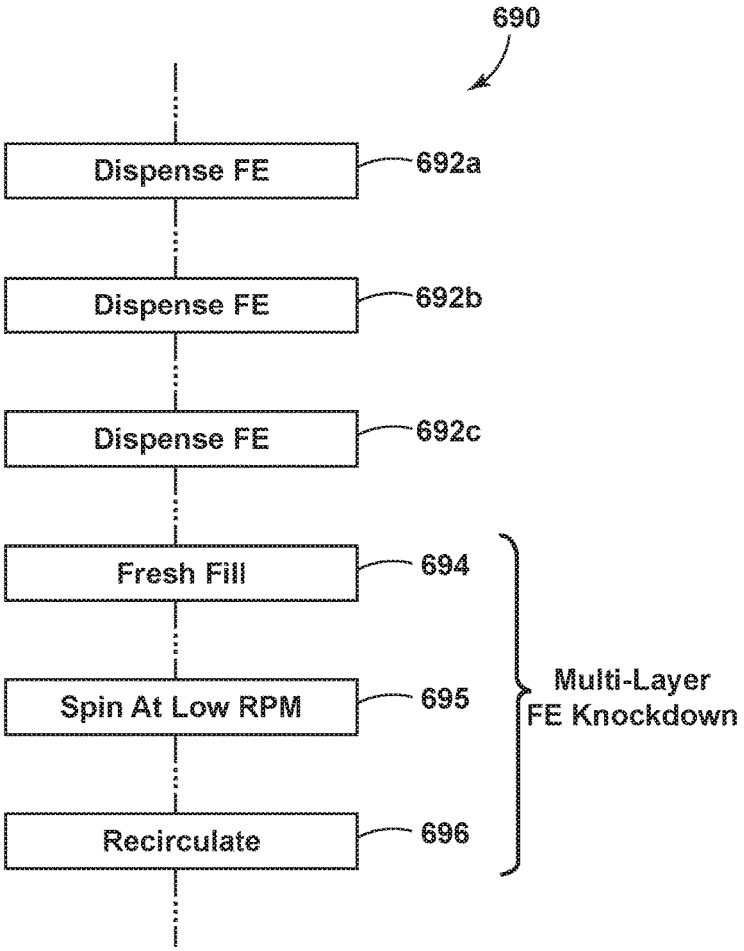
FIG. 7F is an illustrative example of fabric enhancer dispensing operational phases that can be used alone or in combination in order to dispense fabric enhancers in accordance with the present disclosure.

FIG. 7F shows an operational phase 690 that improves uniformity of fabric enhancer distribution, particularly for the situation where the washing machine 200 engages in multiple fabric enhancer dispensation steps that result in a multi-layer accumulation of fabric enhancer onto the fabric of the laundry load. Operational phase 690 shows multiple dispensation steps 692*a-c* that occur as part of a wash cycle. Each of the dispensation steps 692*a-c* can involve the same or different types of fabric enhancers. Dispensation steps 692*a-c* can result in build-up of multiple layers of fabric enhancer onto the fabric being washed.

In response to the multi-layer accumulation, operational phase 690 includes multi-layer fabric enhancer "knockdown" functionality. This knockdown functionality begins with a fresh fill step 694, in which fresh water is brought into the washing machine 200. The fresh fill step 694 operates to knock off built-up layers of fabric enhancer disposed on the laundry. Operational phase 690 then proceeds to a spinning step 695, in which the basket 201 is spun at a low RPM to promote uniform distribution of the knocked-off fabric enhancer. Finally, operational phase 690 proceeds to a recirculating step 696, in which the resultant wash liquor—containing a mixture of knocked-off fabric enhancer of various types—is recirculated into the basket 201 by the washing machine's recirculation system. This also promotes enhanced uniformity, with fabric enhancer being deposited onto portions of the fabric that previously had lower concentrations.

In exemplary implementations, the multiple types of fabric enhancer can provide their own, respective benefits. Alternatively, different fabric enhancers can interact with one another to provide combined benefits. Thus, two sequentially dispensed fabric enhancers can be complementary to one another. As one example, a first fabric enhancer can operate to reduce liquid surface tensions of a soak environment, which then enables a subsequent fabric enhancer to be more uniformly distributed.

Figure 7G:
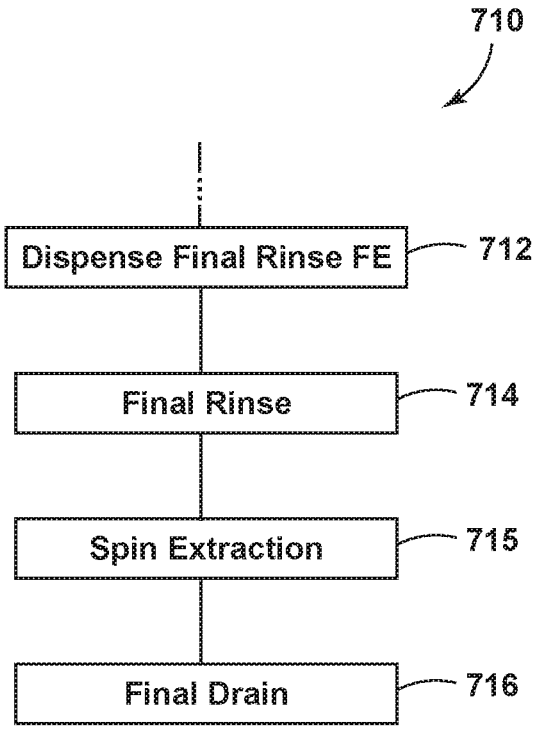
FIG. 7G is an illustrative example of fabric enhancer dispensing operational phases that can be used alone or in combination in order to dispense fabric enhancers in accordance with the present disclosure.

FIG. 7G shows an operational phase 710 for dispensing fabric enhancer. Operational phase 710 is tailored for dispensing a fabric enhancer in the form of a rinse additive that allows more water to be extracted from the laundry load during a spin extraction step. Operational phase 710 includes a dispensing step 712, in which the rinse additive is dispensed. The rinse additive promotes water extraction out of laundry, which is achieved by lowering the surface tension of the water into which the rinse additive is mixed. Examples of chemistry that lower surface tension are surfactants, ethanol, and alcohol combinations. Dispensing these chemistries with hot water may alter surface tension properties as well. Operational phase 710 then proceeds to a rinse step 714, a spin extraction step 715, and a drain step 716. Due to the uniform distribution of the rinse additive, the spin extraction step 715 can be achieved with a lower basket RPM and shorter spin times.

Any sequence or combination of the operational phases depicted in the previously described Figures are within the scope of the present disclosure.

Figure 8:
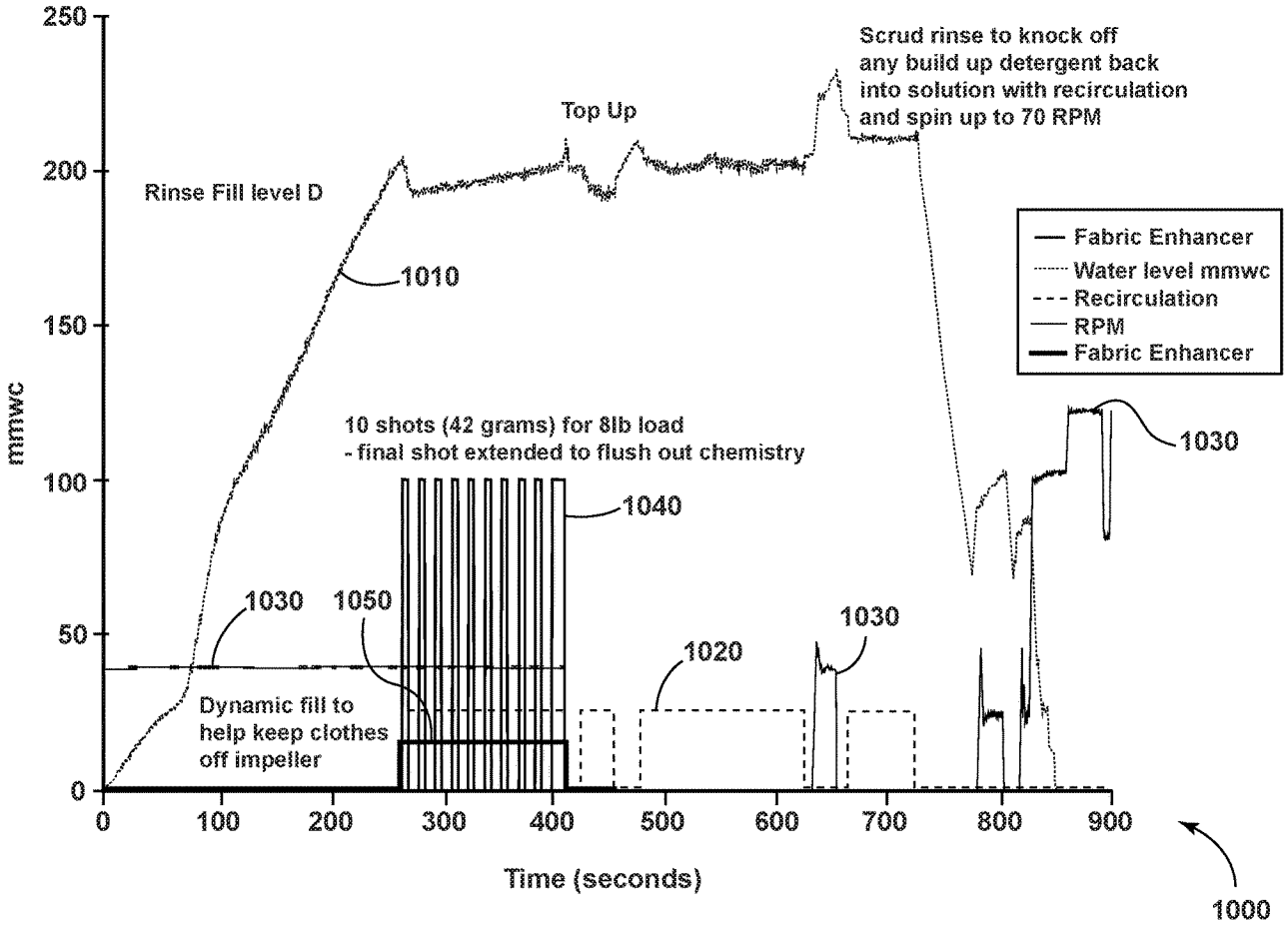
FIG. 8 shows a timing diagram of an exemplary wash cycle in accordance with the present disclosure.

FIG. 8 shows an exemplary timing diagram 1000 in accordance with the present disclosure. The timing diagram 1000 is just one example in accordance with the present disclosure, and should not be interpreted as limiting the scope of the present disclosure in any way.

The timing diagram 1000 shows time on the horizontal axis. The timing diagram 1000 shows a water level (depicted by water column height, in millimeters) over time through line plot 1010—water can be added through any suitable combination of hot or cold water dispensation. The timing diagram 1000 also shows the operation of a recirculation system through line plot 1020. In this example, the recirculation system can either be in an active or inactive state, with the active states depicted as pulses. The timing diagram 1000 also shows the operation of the motor in units of RPM through line plot 1030. The timing diagram 1000 also shows dispensation of a first fabric enhancer through line plot 1040. As shown, the fabric enhancer is dispensed in a series of discrete "shots," each of which corresponds to a dispensation of the above-mentioned water pressure pump. The final "shot" may be extended to flush fabric enhancer out of its storage compartment. Finally, the timing diagram 1000 shows dispensation of a second fabric enhancer through line plot 1050. In this example, the second fabric enhancer is distributed during one prolonged pulse. The first fabric enhancer may be a fabric softener and the second fabric enhancer may be a detergent.

Figure 9:
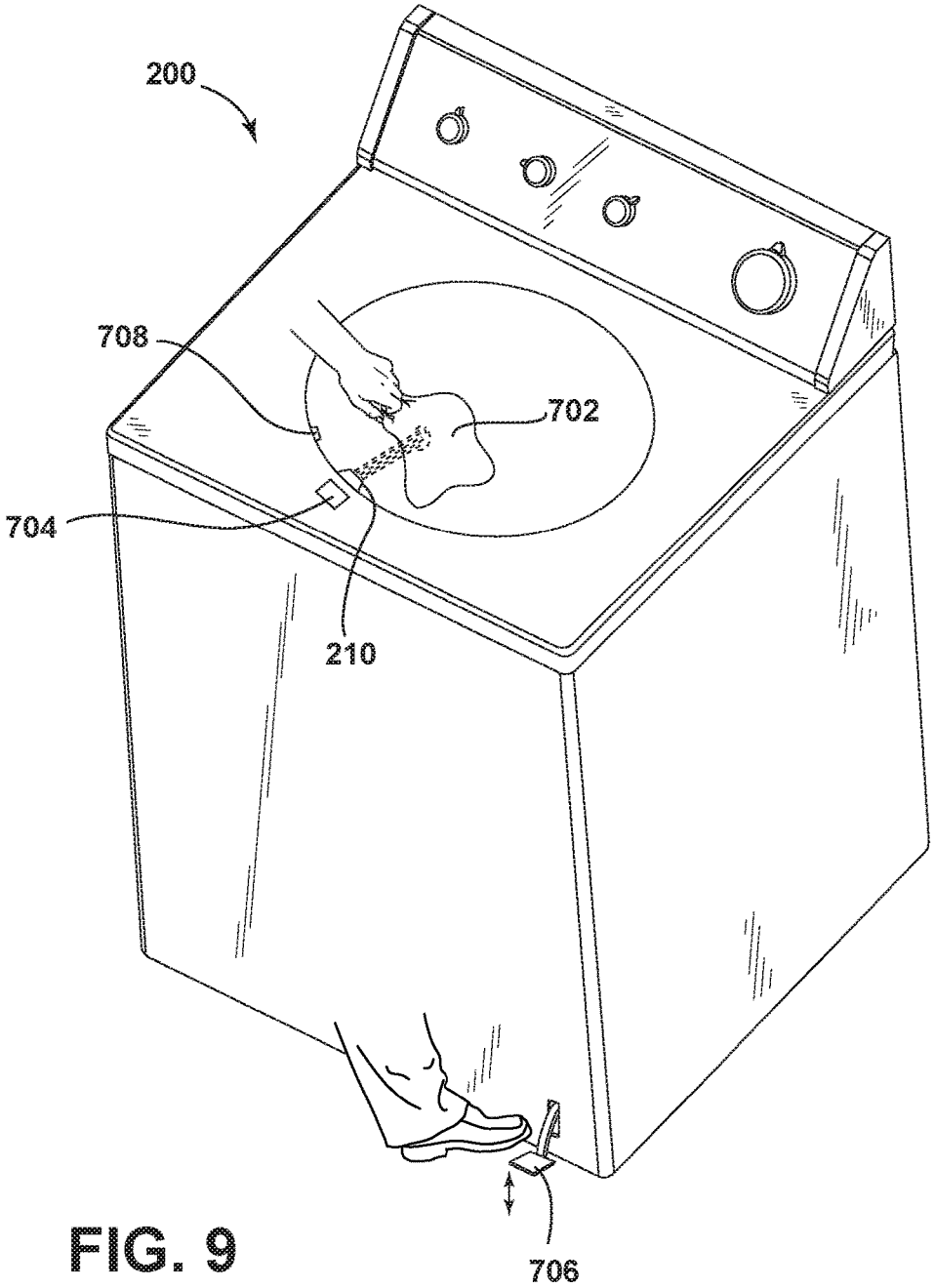
FIG. 9 illustrates the use of a fabric enhancer dispensing system in accordance with the present disclosure in which the user manually dispenses treating chemistries directly onto select areas of a fabric.

FIG. 9 illustrates the use of a fabric enhancer dispensing system by a user for manually dispensing treating chemistries directly onto select areas of a fabric. FIG. 9 shows the washing machine 200 of FIG. 2, which as mentioned includes the dispensing system 262 and the nozzle 210 for uniformly dispensing fabric enhancer into the basket 201.

FIG. 9 also shows additional features of the washing machine 200 that enable manual dispensation of fabric enhancer. In particular, FIG. 9 shows that a user may manually hold a fabric 702 under the nozzle 210 and dispense fabric enhancer directly onto the fabric 702 for purposes of pretreating certain areas of the clothing. To manually dispense the fabric enhancer, the user may push a button 704 or press down on a pedal 706. Alternatively, there may be a sensor 708 that senses that a user has placed the fabric 702 underneath the nozzle 210, with the dispensing system 262 dispensing fabric enhancer out of the nozzle 210 in response to the detection.

Figure 10:
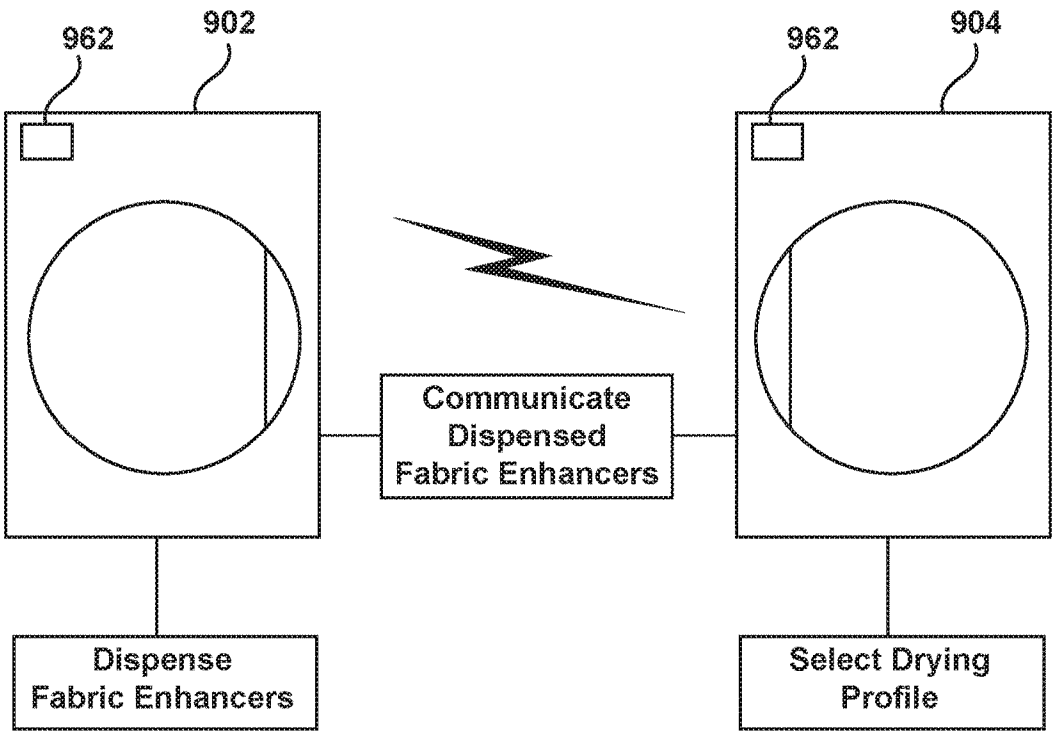
FIG. 10 illustrates laundry treating appliances in the form of a washer and dryer pair, and illustrates that the washer and dryer can are in communication with one another and dispense fabric enhancers in their respective washing and drying cycles in cooperative fashion to improve the combined effect of fabric enhancers dispensed by the washer and the dryer.

FIG. 10 illustrates laundry treating appliances in the form of a washer and dryer pair, and illustrates that the washer and dryer can are in communication with one another and dispense fabric enhancers in their respective washing and drying cycles in cooperative fashion to improve the combined effect of fabric enhancers dispensed by the washer and the dryer. FIG. 10 shows a washing machine 902 and a dryer 904. The washing machine includes a dispensing system 962 similar to the dispensing systems 60, 262 shown in FIGS. 1A and 2A, above. The dryer 904 may optionally include a dispensing system 964 similar to the dispensing systems 60, 262 as well. Communication can be provided through wired (e.g., Ethernet) or wireless (e.g., WiFi) communication. Communication can be direct or can be intermediated via a server (not shown). In exemplary implementations, the washing machine 902 and the dryer 904 are both Internet-connected appliances.

The washing machine 902 may dispense fabric enhancers using the systems, components, and methodologies discussed above. Certain types of fabric enhancers require, or at least benefit from, certain types of drying profiles so that the fabric enhancers can be suitably set, cured, and/or polymerized on the surface of or within the interstitial structures of the fabric. Thus, the effectiveness of different types of fabric enhancers may improve with the application of different types of heating and/or drying profiles. For example, certain types of fabric enhancers may have improved efficacy if exposed to high heat for a short period of time, others may benefit from low levels of heat for a prolonged period of time, others may benefit from different ramping rates of heat increase and decrease, etc.

Generally, a suitable drying temperature profile will be informed by the type of fabric finish that is desired. For example, for finishes that should stay on the surface of the fabric, such as fabric softeners or stain guards, drying profiles should be selected to provide high temperatures so that the water is driven off quickly. This prevents the active ingredients of the fabric enhancers from leaving the surface of the clothing to the external environment and/or to the interior of the fabric. In contrast, for fabric enhancers that should penetrate between and into the internal, interstitial structure of the fabric, such as shape management, soil release, or wrinkle guards, drying temperatures may preferably be lower. This enables the active ingredients to have sufficient time to transition into the interior structures of fabric.

Accordingly, the washing machine 902 may communicate to the dryer 904 indications of the fabric enhancers that were dispensed onto the laundry. The dryer 904 can then select a drying profile best suited for that type of fabric enhancer. For example, the dryer 904 may include a memory configured with a look-up table that contains different drying profiles and correlates those drying profiles to different chemistry types. For finishes that should stay on the surface of the fabric, such as fabric softeners or stain guards, the dryer 904 selects drying profiles having high temperatures. In contrast, for fabric enhancers that should penetrate between and into the internal, interstitial structure of the fabric, such as shape management, soil release, or wrinkle guards, the dryer 904 selects drying profiles having lower temperatures.

According to one aspect of the present disclosure, the washing machine 902 dispenses fabric enhancers that facilitate or enhance the drying process. In conventional laundry systems, users may add dryer sheets to the laundry load within a dryer in order to improve the look, feel, fragrance, and/or static properties of clothing. There are disadvantages to this approach, including that it is a nuisance for the user to add dryer sheets into the dryer, the user may forget to add dryer sheets, and the dryer sheets may not provide uniform distribution of fabric enhancing properties.

Thus, the washing machine 902 may dispense a fabric enhancer during a final rinse operation that will facilitate subsequent drying, such as by lowering the surface tension of water to the fabrics. The washing machine 902 may also dispense, during a final rinse operation, fabric enhancers that provide the properties of typical dryer sheets, including fragrance, softening, and/or reduced static. When the user moves the clothing to the dryer 904, the clothing will have been appropriately and uniformly pre-treated by the washing machine 902, resulting in a faster drying cycle and obviating the need to add dryer sheets. In effect, treatments that may conventionally occur in the dryer 904 can be instead provided by the washing machine 902 due to the benefits of uniform distribution provided by the present disclosure.

Dryer 904 may also be configured with a fabric enhancer dispensing similar to the fabric enhancer dispensing systems 60, 262 of FIGS. 1A and 2. However, it may instead be advantageous for the washing machine 902 to dispense dryer-related fabric enhancing additives during its final rinse. This is because the washing machine 902 can be cleaned relatively easily with water-intensive cleaning cycles. In contrast, dryers are not conducive for water-based cleaning cycles, and fabric enhancers may build up in the dryer 904 over time, which can clog orifices or pathways of the dryer (e.g., nozzles, vents, drains, etc.).

The disclosure above sets forth systems, components, and methodologies for uniform distribution of fabric enhancers. Exemplary types of fabric enhancers that are in accordance with the present disclosure are set forth below, along with benefits that they may provide and how they may best be introduced into wash cycles.

Whitening or bluing agents are one class of fabric enhancers in accordance with the present disclosure. (As known, bluing agents can give fabrics a visual appearance of being cleaner and more white.) Chemical active ingredients for whitening and/or bluing agents are conventionally known. Preferably, the whitening and/or bluing agents are dispensed at or near the end of the spin extraction after a final rinse. Preferably, the whitening and/or bluing agents will be well-mixed with water prior to application onto fabrics.

Color fidelity and vibrancy agents are another class of fabric enhancers in accordance with the present disclosure. Examples of such fabric enhancers may include cellulase as an active ingredient, which may help to diminish "pilling." Pilling refers to unsightly fabric features that appear on fabrics due to mechanical friction on the fabrics during use or during wash, and which diminish reflection of light resulting in loss of vibrancy. Preferably, cellulase-based fabric enhancers may be dispensed at or towards the end of a wash cycle (particularly in the vertical axis context) and/or at or near the first rinse (particularly in the horizontal axis context) to allow any pilling generated after agitation of the laundry to be hydrolyzed and removed. The rinse time may be extended to provide the cellulase with sufficient time to react with the pilling. The temperature and water volume of the rinse can be optimized as appropriate. Preferably, sufficient water is provided during the final rinse so that the cellulase is sufficiently rinsed away and its chemical reactions do not continue for prolonged periods of time, which can damage clothing.

Other color fidelity and vibrancy agents may include fabric enhancers with lubricating polymers as active ingredients. These may operate to lay down any pilling artifacts against the fabric's surface, allowing greater light reflection and enhanced vibrancy. Such fabric enhancers may be added during the final rinse of a wash cycle, and preferably as part of a wash cycle that uses the recirculation methodologies discussed above to maintain a low water environment (see, e.g., FIG. 7D).

Odor prevention agents are another class of fabric enhancers in accordance with the present disclosure. Such treatment agents may include fragrances, perfumes, and/or odor-trapping molecules. Suitable active ingredients may include a variety of fragrances, perfumes, and/or odor-trapping molecules (e.g., hydroxypropyl beta-cyclodextrin). Such fabric enhancers may preferably be added at the end of extraction after the final rinse.

Odor prevention agents may also include anti-microbial fabric finishes, which can be applied as a one-time treatment or periodically applied to "recharge" fabrics. Suitable active ingredients may include anti-bacterials, such as silver nitrate ions or chitosan. Odor prevention agents may also be oleophobic polymers, including in the form of fluorinated polymers, such as Teflon. Anti-bacterial fabric enhancers may preferably be added in the final rinse, and preferably as part of a wash cycle that uses the recirculation methodologies discussed above to maintain a low water environment.

Stain repellant agents are another class of fabric enhancers in accordance with the present disclosure. Such fabric enhancers may contain a polymer consisting of a repeating hydrophobic and/or oleophobic group. Such a hydro/oleophobic group, once coating the fabric surface, may operate to repel water and oil-based stains. These fabric enhancers may be suitable for both natural or otherwise hydrophilic fibers as well as synthetic fibers. Active ingredients may include a highly fluorinated polymer such as teflon, but may also or alternatively contain: silanes, silicones, a wax-based elastomer (water-repellent), paraffin emulsions (water-repellent), and the like. These fabric enhancers may preferably be dispensed at the end of final rinse and spin cycles. They are preferably disposed as to provide an even coating on the surface of the garment.

Soil release agents are another class of fabric enhancers in accordance with the present disclosure, either alone or in combination with a stain repellant to provide dual-action functionality. Such fabric enhancers may include a polymer consisting of a repeating hydrophilic group. The hydrophilic group, once embedded into a fabric, enables penetration of aqueous wash solutions into the fabric during a laundering cycles, allowing the water and detergent to attack deep into and below stains, releasing them more effectively during the wash process. These fabric enhancers may be used on synthetic or otherwise hydrophobic garments as well as natural fiber garments. They are preferably disposed as to penetrate deep within the fibers of the garment, and then heat may be applied (e.g., by the dryer) to set or polymerize the finish. Active ingredients for soil release fabric enhancers may include a fluorinated copolymer, and may also contain: silanes, siloxanes, functionalized polyesters or nylons (ethoxylated or sulfonated), esters, ethoxylated silicone polymers, cellulosic polymers, polyoxyethylene polymers, etc. The fabric enhancer may also contain a wetting agent to enhance penetration of the chemistry into the fabrics. These fabric enhancers may preferably be dispensed at the end of final rinse and spin cycles.

Shape management agents are another class of fabric enhancers in accordance with the present disclosure. Shape management agents may improve the resilience of the garment to provide a wrinkle-free/wrinkle-release function and/or may stiffen the garment. Exemplary active ingredients may include polyvinyl alcohol (PV-OH) polymer and/or a chemical resin (e.g. urea-based polymers, DMDHEU, or the like). Preferably, the fabric enhancer will uniformly coat both the surface of the garment and will penetrate into and between the fibers.

UV protectants are another class of fabric enhancers in accordance with the present disclosure. Such fabric enhancers may include UV-absorbing or UV-blocking compounds or molecules. UV-absorbers are typically aromatic compounds which absorb UV light, protecting chromophores in the garments and skin cells of the consumer wearing the garment. Exemplary active ingredients may include triazine-derived UV-absorbers (e.g. benzotriazole, hydroxyphenyl-triazine) or phenyl-based UV-absorbers (benzophenone). UV-blockers are typically metal oxide molecules which block and reflect UV light (for example, as used in sun screens). Exemplary active ingredients may include UV-blockers (e.g. metal oxides such as titanium dioxide or zinc oxide). Preferably, UV protectants are dispensed during the final rinse and uniformly coat the surface of the garment.

While this invention has been described in conjunction with the specific embodiments outlined above, it is evident that many alternatives, modifications and variations will be apparent to those skilled in the art. Accordingly, the various embodiments of the invention, as set forth above, are intended to be illustrative, not limiting. Various changes may be made without departing from the spirit and scope of the invention.

Although certain disclosure set forth above was discussed in relation to a horizontal axis washing machine in particular or a vertical axis washing machine in particular, it should be understood that all of the disclosure set forth above could be implemented in either a horizontal axis washing machine, a vertical axis washing machine, or a dryer. Generally, a laundry treating appliance in accordance with the present disclosure may be any appliance that performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

Although certain illustrative embodiments have been described in detail above, variations and modifications exist within the scope and spirit of this disclosure as described and as defined in the claims included in this application.

The invention claimed is:

1. A method of executing a washing cycle in a laundry appliance, the method comprising:

dispensing one or more of the laundry detergent, fabric softener, and bleach into the treating chamber of the laundry treating appliance;

wherein the plurality of fabric enhancers are of types that are different from the laundry detergent, fabric softener, and the bleach;

receiving at the user interface a user selection of an Indication of the types of fabric enhancers stored in the plurality of compartments:

receiving at the user interface a user selection of a dispensation pattern for dispensing each of the types of fabric enhancers; and dispensing the plurality of fabric enhancers from the plurality of compartments based on the user indication of the types of fabric enhancers stored in each of the plurality of compartments and in accordance with the selected dispensation patterns, selecting the dispensation patterns from among a periodic dripping spray pattern, a non-pressurized gravity-based flow pattern, a pressurized stream flow pattern, and a conical spray pattern.

2. The method of claim 1, wherein the types of fabric enhancers include one or more of stain guard fabric enhancers, anti-microbial fabric enhancers, UV protector fabric enhancers, wrinkle releaser fabric enhancers, stiffener fabric enhancers, malodor prevention fabric enhancers, stain repellant fabric enhancers, shaper management fabric enhancers, and fragrance enhancers.

3. The method of claim 1, wherein the selected dispensation pattern is a fanned distribution pattern having an angular extent that spans radially from a central rotational axis of the treating chamber to an outer circumference of the treating chamber.

4. The method of claim 1, wherein the selected dispensation pattern is a pressurized stream targeting an outer circumference of the treating chamber.

5. The method of claim 1, comprising:

dispensing one of the types of fabric enhancers towards a center of a rotating impeller;

rotating the treating chamber to satellize the laundry load; and continuing to rotate the treating chamber such that the one of the types of fabric enhancers is drawn radially outwards, from the center of the rotating impeller towards an outer circumference of the treating chamber.

6. The method of claim 1, comprising dispensing one of the types of fabric enhancers by pre-mixing the fabric enhancer with water utilizing a water pressure pump that applies a shear force sufficient to break apart vesicles in the fabric enhancer.

7. The method of claim 6, further comprising exposing, prior to dispensation, the one of the types of fabric enhancers to water, wherein the water has a temperature of between about 40° C. and about 60° C. and a volume of between about two times and about three times the volume of the fabric enhancer.

8. The method of claim 1, further comprising:

prewetting the laundry load with water to a residual moisture content of between about 30% and about 50%;

pumping one of the types of fabric enhancers through a water pressure pump while mixing the one of the types of fabric enhancers with water according to a predetermined ratio;

dispensing the one of the types of fabric enhancers into the treating chamber; and filling the treating chamber with fresh water and agitating the laundry load to redistribute layers of the one of the types of fabric enhancers built up on the laundry load.

9. The method of claim 1, further comprising:

[a] filling the treating chamber with water to a predetermined level;

[b] after filling the treating chamber with the water, dispensing one of the types of fabric enhancers into the treating chamber;

[c] after dispensing the fabric enhancer, agitating the laundry load;

[d] after agitating the laundry load, rotating the treating chamber at sufficient speed to satellize the laundry load;

[e] slowing down the rotation of the treating chamber; and repeating steps [a]-[e].

10. The method of claim 1, further comprising:

repeatedly dispensing one of the types of fabric enhancers onto the laundry load during a plurality of fabric enhancer dispensing operations;

allowing layers of the fabric enhancer to accumulate on the laundry load;

knocking down the accumulated layers of the fabric enhancer by filling the treating chamber with fresh water;

rotating the treating chamber to mix the knocked down fabric enhancer with the fresh water to generate a wash liquor; and recirculating the wash liquor onto the laundry load.

11. The method of claim 1, wherein receiving indications of the types of fabric enhancers stored in the respective compartments comprises accepting inputs by a user via a user interface that specify which type of fabric enhancer the user loaded into which respective compartment.

12. The method of claim 1, further comprising dispensing one of the types of fabric enhancers during a rinse operation of the washing cycle.

* * * * *